US012203678B2

(12) United States Patent
Feria

(10) Patent No.: US 12,203,678 B2
(45) **Date of Patent: *Jan. 21, 2025**

(54) VALVE SYSTEM AND METHODS

(71) Applicant: Ralph Feria, Easley, SC (US)

(72) Inventor: Ralph Feria, Easley, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/186,358

(22) Filed: Mar. 20, 2023

(65) Prior Publication Data

US 2023/0228430 A1 Jul. 20, 2023

Related U.S. Application Data

(63) Continuation of application No. 17/745,193, filed on May 16, 2022, now Pat. No. 11,608,995, which is a (Continued)

(51) Int. Cl.
*F24F 11/84* (2018.01)
*F24F 3/08* (2006.01)

(Continued)

(52) U.S. Cl.
CPC ..... *F24F 3/08* (2013.01); *F24F 5/0003* (2013.01); *F24F 11/84* (2018.01); *F24F 11/89* (2018.01);

(Continued)

(58) Field of Classification Search
CPC .... F24F 3/08; F24F 11/84; F24F 11/89; F24F 5/0003; F24F 5/089; F24F 2110/10;

(Continued)

(56) References Cited

U.S. PATENT DOCUMENTS 3,127,928 A 4/1964 Ringquist
3,704,965 A 12/1972 Mentschel et al.

(Continued)

FOREIGN PATENT DOCUMENTS

CN 201396865 Y 2/2010
CN 106574732 A 4/2017

(Continued)

OTHER PUBLICATIONS

Extended European Search Report dated Feb. 15, 2022 in counterpart European Patent Application Serial No. 20774668.6.

(Continued)

*Primary Examiner* — Avinash A Savani
(74) *Attorney, Agent, or Firm* — Fox Rothschild LLP

(57) ABSTRACT

A water distribution apparatus and method including cold and hot water supplies, a fan coil (or chilled beam device), a control valve having cold and hot water inlets and outlets, cold and hot water outputs configured to supply cold and hot water to the fan coil, cold and hot water return inlets configured to receive from the fan coil the water supplied by the cold and/or water outputs and outputting the cold and/or hot water to the cold and hot water supply lines, respectively, via the cold and hot water outlets, respectively. Cold and hot water is supplied from the cold and/or hot water outputs to the fan coil and received into the cold and hot water return inlets, respectively, and the cold and hot water supplied by the cold and hot water outputs to the fan coil is output to the cold and hot water supply lines, respectively.

8 Claims, 19 Drawing Sheets

Related U.S. Application Data continuation of application No. 16/821,692, filed on Mar. 17, 2020, now Pat. No. 11,333,370.

(60) Provisional application No. 62/819,608, filed on Mar. 17, 2019.

(51) Int. Cl.

| | |
|---|---|
| ***F24F 5/00*** | (2006.01) |
| ***F24F 11/89*** | (2018.01) |
| ***F24H 9/13*** | (2022.01) |
| ***F25B 27/02*** | (2006.01) |
| *F24F 110/10* | (2018.01) |
| *F24H 4/04* | (2006.01) |

(52) U.S. Cl.

CPC ..... *F24H 9/13* (2022.01); *F24H 9/133* (2022.01); *F25B 27/02* (2013.01); *F24F 5/0089* (2013.01); *F24F 2110/10* (2018.01); *F24H 4/04* (2013.01)

(58) Field of Classification Search

CPC ... F24H 9/13; F24H 9/133; F24H 4/04; F25B 27/02

USPC ..... 122/31.1

See application file for complete search history.

(56) References Cited

U.S. PATENT DOCUMENTS

| | | | |
|---|---|---|---|
| 6,112,545 | A | 9/2000 | Stethem |
| 9,500,394 | B2 | 11/2016 | Manzo |
| 9,671,125 | B2 | 6/2017 | Mowris et al. |
| 9,677,777 | B2 | 6/2017 | Karamanos et al. |
| 10,895,329 | B2 | 1/2021 | Doya et al. |
| 2013/0199772 | A1 | 8/2013 | Fischer |
| 2013/0233008 | A1 | 9/2013 | Yamashita |
| 2017/0067656 | A1 | 3/2017 | Guidetti et al. |
| 2017/0067665 | A1 | 3/2017 | Whitmore |
| 2019/0162323 | A1 | 5/2019 | Aikawa et al. |

FOREIGN PATENT DOCUMENTS

| | | | |
|---|---|---|---|
| DE | 112016005665 | T5 | 8/2018 |
| DE | 202019104586 | U1 | 4/2020 |
| EP | 2863131 | A1 | 4/2015 |
| WO | 2008113121 | A1 | 9/2008 |
| WO | 2015173071 | A1 | 11/2015 |

OTHER PUBLICATIONS

Chinese First Office Action dated Oct. 21, 2022 for counterpart Chinese Patent Application Ser. No. 202080036728.3.

International Search Report and Written Opinion dated Jun. 11, 2022 in counterpart Patent Cooperation Treaty (PCT) Application Ser. No. PCT/US2020/0023199.

Office Action dated Oct. 18, 2024 for counterpart continuation-in-part application (U.S. Appl. No. 18/792,068, filed Aug. 1, 2024).

| Mode | Outdoor Coil 128 Mode | Outdoor Fan 156 | Compressor 124 Speed / Variable Capacity | Valves Open | Expansion Valve (EEV) Active | Groundwater / Ground Loop |
|---|---|---|---|---|---|---|
| **Simultaneous Heat and Cool (SHC) (FIG. 1A)** | Not used | Not used | Control system 400 automatically modulates on cold or hot water temperature set point proximity | SV-1B<br>SV-2B<br>SV-3 | EEV A | Takes heat from, or rejects heat to groundwater / ground loop as optimization requires |
| **Heat Only (FIG. 1B)** | Evaporator | Modulates on ambient temperature and refrigerant pressure | Control system 400 automatically modulates on hot water temperature set point proximity | SV-1B<br>SV-2A<br>SV-2B<br>4 | EEV A or EEV B (EEV A- if heat from ground water; EEV B- if heat from air) | Takes heat from groundwater / ground loop when heat from the air is no longer the optimal choice |
| **Cool Only (FIG. 1C)** | Condenser | Modulates speed on pressure and liquid temperature | Control system 400 automatically modulates on water temperature | SV-1A<br>SV-3 | EEV A | Rejects heat to groundwater / ground loop if more efficient |
| **Defrost (FIG. 1D)** | Changes from evaporator to condenser | Off | Control system 400 automatically modulates depending on the calculated defrost interval | SV-1A<br>SV-3 | EEV A | Takes heat from ground water / ground loop or chilled water loop to optimize defrost |

FIG. 4

VALVE SYSTEM AND METHODS

RELATED APPLICATION DATA

This application is a continuation of, and claims priority to, U.S. patent application Ser. No. 17/745,193, filed May 16, 2022, which is a continuation of, and claims priority to, U.S. patent application Ser. No. 16/821,692, filed Mar. 17, 2020 (issued May 17, 2022, as U.S. Pat. No. 11,333,370), which claims priority under 35 U.S.C. § 119(e) from U.S. Provisional Patent Application Ser. No. 62/819,608, filed Mar. 17, 2019, the entirety of all of which are being hereby incorporated by reference in their entirety.

BACKGROUND

The present disclosure relates generally to the field of controlling the water distribution in systems used in heating, ventilation, air conditioning, refrigeration, fluid heating and chilling and valve systems and methods therefor.

Various systems are available for heating, ventilation, air conditioning, refrigeration, fluid heating and chilling. Such systems can be dedicated to heating or to cooling, or, for example, in the case of heat pump systems, the direction of a refrigerant flow can be reversed through heat exchangers in forced-air systems to either allow for absorption of heat from a space for the cooling such space or for absorption heat from the outdoors for the heating of such space. In this type of arrangement, forced-air flows over the heat exchanger through ductwork to such space.

Heat pump systems may also be used in ductless systems, including direct expansion systems, where a refrigerant heat exchanger is typically in the space to be heated and/or cooled. Variable refrigerant flow systems are examples of direct expansion systems and may offer benefits in certain applications, including improved energy efficiency. Such systems may use one or more condensing units and provide refrigerant to one or more evaporator units in a ductless manner.

In certain situations, conventional direct expansion systems may involve safety issues in that because one or more of the heat exchangers is in the space being heated and/or cooled, in the event of a refrigerant leak, the refrigerant may leak into such space. Certain refrigerant gas is heavier than air and can displace oxygen in a room or space, and in extreme situations, could displace a sufficient amount of oxygen from a space such that a person could succumb to suffocation. As certain refrigerants cannot generally be detected by a person through sight, smell, or otherwise, the severity of such a refrigerant leak could become grave.

Accordingly, apparatuses and methods intended to address the above concerns would find utility. Toward that end, there is a need for heating and chilling systems that use a for a fluid such as water, which provide increased efficiency and which also lessen the risk of injury to persons in the event of a refrigerant leak, and also a need for controlling the water flow in such systems.

SUMMARY

The following is a non-exhaustive list of exemplary implementations according to the present disclosure, which may or may not be claimed.

One exemplary implementation of the present disclosure relates to a valve system for use in connection with heating, ventilation, air conditioning, refrigeration, fluid heating and/or chilling applications.

Another exemplary implementation of the present disclosure relates to a method incorporating a valve system for use in connection with heating, ventilation, air conditioning, refrigeration, fluid heating and/or chilling applications.

A further exemplary implementation of the present disclosure relates to a valve system for use in connection with a heat source optimization system that uses water to move heating and or cooling from one location to another.

A still further exemplary implementation of the present disclosure relates to a method incorporating a valve system for use in connection with a heat source optimization system that uses water to move heating and or cooling from one location to another.

In another exemplary implementation, a water distribution apparatus and method are provided including cold and hot water supplies, a fan coil (or chilled beam device), a control valve having cold and hot water inlets and outlets, cold and hot water outputs configured to supply cold and hot water to the fan coil, cold and hot water return inlets configured to receive from the fan coil the water supplied by the cold and/or water outputs and outputting the cold and/or hot water to the cold and hot water supply lines, respectively, via the cold and hot water outlets, respectively. Cold and hot water is supplied from the cold and/or hot water outputs to the fan coil and received into the cold and hot water return inlets, respectively, and the cold and hot water supplied by the cold and hot water outputs to the fan coil is output to the cold and hot water supply lines, respectively.

In one exemplary implementation of the present disclosure, a system is provided for controlling the water distribution in systems used in at least one of a heating, ventilation, air conditioning, refrigeration, fluid heating and chilling configuration for heating or cooling a space or a fluid. The system includes a cold water supply adapted to supply cold water and a hot water supply adapted to supply hot water. At least one fan coil or chilled beam device is provided, as is a cold water supply line in fluid communication with the cold water supply and a hot water supply line in fluid communication with the hot water supply. At least one control valve device is provided, and control valve device has: (a) a cold water inlet in fluid communication with and configured to receive cold water from the cold water supply line; (b) a cold water outlet in fluid communication with and configured to supply cold water to the cold water supply line; (c) a cold water output in fluid communication with and configured to supply cold water from the cold water supply to the fan coil or chilled beam device; (e) a cold water return inlet in fluid communication with and configured to receive from the fan coil or chilled beam device the cold water supplied by the cold water output and outputting the cold water to the cold water supply line via the cold water outlet; (f) a hot water inlet in fluid communication with the hot water supply line; (g) a hot water return outlet in fluid communication with the hot water supply line; (h) a hot water output in fluid communication with and configured to supply hot water from the hot water supply to the fan coil or chilled beam device; and (i) a hot water return inlet in fluid communication with and configured to receive from the fan coil or chilled beam device the hot water supply line via the hot water return outlet. At least one thermostat is provided, as is a pump in fluid communication with the fan coil or chilled beam and the cold water output and the hot water output of the control valve. The thermostat is in communication with at least one of the control valve, the pump, and the fan coil or chilled beam and is configured to selectively control at least one of the flow rates of cold water and/or hot water through the control valve, the pump, and the fan coil or chilled beam.

In one exemplary implementation of the present disclosure, a system is provided for controlling the water distribution in systems used in at least one of a heating, ventilation, air conditioning, refrigeration, fluid heating and chilling configuration for heating or cooling a space or a fluid. The system includes a cold water supply adapted to supply cold water and a hot water supply adapted to supply hot water. A first fan coil or chilled beam device, a second fan coil or chilled beam device, a third fan coil or chilled beam device, and a fourth fan coil or chilled beam device are provided, as is a cold water supply line in fluid communication with the cold water supply and a hot water supply line in fluid communication with the hot water supply. A first control valve device, a second control valve device, a third control valve device, and a fourth control valve device are provided, and each of the first control valve device, the second control valve device, the third control valve device, and the fourth control valve device being a six-way control valve and having: (a) a cold water inlet in fluid communication with and configured to receive cold water from the cold water supply line; (b) a cold water outlet in fluid communication with and configured to supply cold water to the cold water supply line; (c) a cold water output in fluid communication with and configured to supply cold water from the cold water supply to at least one of the first fan coil or chilled beam device, the second fan coil or chilled beam device, the third fan coil or chilled beam device, and the fourth fan coil or chilled beam device; (e) a cold water return inlet in fluid communication with and configured to receive from at least one of the first fan coil or chilled beam device, the second fan coil or chilled beam device, the third fan coil or chilled beam device, and the fourth fan coil or chilled beam device the cold water supplied by the cold water output and outputting the cold water to the cold water supply line via the cold water outlet; (f) a hot water inlet in fluid communication with the hot water supply line; (g) a hot water return outlet in fluid communication with the hot water supply line; (h) a hot water output in fluid communication with and configured to supply hot water from the hot water supply to at least one of the first fan coil or chilled beam device, the second fan coil or chilled beam device, the third fan coil or chilled beam device, and the fourth fan coil or chilled beam device; and (i) a hot water return inlet in fluid communication with and configured to receive from at least one of the first fan coil or chilled beam device, the second fan coil or chilled beam device, the third fan coil or chilled beam device, and the fourth fan coil or chilled beam device the hot water supplied by the hot water output and outputting such hot water to the hot water supply line via the hot water return outlet. A first cold water tee in the cold water supply line has a first cold water outlet connected to the cold water inlet of the first control valve device, and a second cold water outlet is connected to the cold water inlet of the second control valve device. A first hot water tee in the hot water supply line has a first hot water outlet connected to the hot water inlet of the first control valve device, and a second hot water outlet is connected to the hot water inlet of the second control valve device. A second cold water tee in the cold water supply line is downstream of the first cold water tee and has a first cold water outlet connected to the cold water inlet of the third control valve device, and a second cold water outlet is connected to the cold water inlet of the fourth control valve device. A second hot water tee in the hot water supply line is downstream of the first hot water tee and has a second hot water outlet connected to the hot water inlet of the third control valve device, and a second hot water outlet is connected to the hot water inlet of the fourth control valve device. A third cold water tee is connected to the cold water supply line and has a first cold water inlet connected to the cold water return outlet of the first control valve device and a second cold water inlet connected to the cold water return outlet of the second control valve device. A third hot water tee is connected to the hot water supply line and has a first hot water inlet connected to the hot water return outlet of the first control valve device and a second hot water inlet connected to the hot water return outlet of the second control valve device. A fourth cold water tee is connected to the cold water supply line downstream of the first cold water tee and has a first cold water inlet connected to the cold water return outlet of the third control valve device and a second cold water inlet connected to the cold water return outlet of the fourth control valve device. A fourth hot water tee is connected to the hot water supply line downstream of the first hot water tee and has a first hot water inlet connected to the hot water return outlet of the third control valve device and a second hot water inlet connected to the hot water return outlet of the fourth control valve device. A first thermostat, a second thermostat, a third thermostat, and a fourth thermostat, each being configured to sense the temperature of at least one of the space or the fluid are provided, as is a first pump in fluid communication with the first fan coil or chilled beam and at least one of the cold water output and the hot water output of the first control valve, a second pump in fluid communication with the second fan coil or chilled beam and at least one of the cold water output and the hot water output of the second control valve, a third pump in fluid communication with the third fan coil or chilled beam and at least one of the cold water output and the hot water output of the third control valve, and a fourth pump in fluid communication with the fourth fan coil or chilled beam and at least one of the cold water output and the hot water output of the fourth control valve. The first thermostat is in communication with at least one of the first control valve, the first pump, and the first fan coil or chilled beam and is configured to selectively control at least one of the flow rates of cold water and/or hot water through the first control valve, the first pump, and the first fan coil or chilled beam. The second thermostat is in communication with at least one of the second control valve, the second pump, and the second fan coil or chilled beam and is configured to selectively control at least one of the flow rates of cold water and/o hot water through the second control valve, the second pump, and the second fan coil or chilled beam. The third thermostat is in communication with at least one of the third control valve, the third pump, and the third fan coil or chilled beam and is configured to selectively control at least one of the flow rates of cold water and/or hot water through the third control valve, the third pump, and the third fan coil or chilled beam, and the fourth thermostat is in communication with at least one of the fourth control valve, the fourth pump, and the fourth fan coil or chilled beam and is configured to selectively control at least one of the flow rates of cold water and/or hot water through the fourth control valve, the fourth pump, and the fourth fan coil or chilled beam.

In another exemplary implementation of the present disclosure, a system is provided for controlling the water distribution in systems used in at least one of a heating, ventilation, air conditioning, refrigeration, fluid heating and chilling configuration for heating or cooling a space or a fluid. The system includes a cold water supply adapted to supply cold water and a hot water supply adapted to supply hot water. A first fan coil or chilled beam or fan coil device, a second fan coil or chilled beam or fan coil device, a third fan coil or chilled beam or fan coil device, and a fourth fan coil or chilled beam or fan coil device are provided, as is a first cold water supply line and a second cold water supply line (each in fluid communication with the cold water supply) and a first hot water supply line and a second hot water supply line (each in fluid communication with the hot water supply). A first control valve device, a second control valve device, a third control valve device, and a fourth control valve device are provided. Each of the first control valve device, the second control valve device, the third control valve device, and the fourth control valve device are a six-way control valve and have: (a) a cold water inlet in fluid communication with and configured to receive cold water from the cold water supply line; (b) a cold water outlet in fluid communication with and configured to supply cold water to the cold water supply line; (c) a cold water output in fluid communication with and configured to supply cold water from the cold water supply to at least one of the first fan coil or chilled beam device, the second fan coil or chilled beam device, the third fan coil or chilled beam device, and the fourth fan coil or chilled beam device; (e) a cold water return inlet in fluid communication with and configured to receive from at least one of the first fan coil or chilled beam device, the second fan coil or chilled beam device, the third fan coil or chilled beam device, and the fourth fan coil or chilled beam device the cold water supplied by the cold water output and outputting the cold water to the cold water supply line via the cold water outlet; (f) a hot water inlet in fluid communication with the hot water supply line; (g) a hot water return outlet in fluid communication with the hot water supply line; (h) a hot water output in fluid communication with and configured to supply hot water from the hot water supply to at least one of the first fan coil or chilled beam device, the second fan coil or chilled beam device, the third fan coil or chilled beam device, and the fourth fan coil or chilled beam device; and (i) a hot water return inlet in fluid communication with and configured to receive from at least one of the first fan coil or chilled beam device, the second fan coil or chilled beam device, the third fan coil or chilled beam device, and the fourth fan coil or chilled beam device the hot water supplied by the hot water output and outputting such hot water to the hot water supply line via the hot water return outlet. A first thermostat, a second thermostat, a third thermostat, and a fourth thermostat, each being configured to sense the temperature of at least one of the space or the fluid are provided, as are a first pump in fluid communication with the first chilled beam or fan coil and at least one of the cold water output and the hot water output of the first control valve, a second pump in fluid communication with the second chilled beam or fan coil and at least one of the cold water output and the hot water output of the second control valve, a third pump in fluid communication with the second chilled beam or fan coil and at least one of the cold water output and the hot water output of the third control valve, and a fourth pump in fluid communication with the second chilled beam or fan coil and at least one of the cold water output and the hot water output of the fourth control valve. The first thermostat is in communication with at least one of the first control valve, the first pump, and the first chilled beam or fan coil and is configured to selectively control at least one of the flow rates of cold water and/or hot water through the first control valve, the first pump, and the first chilled beam or fan coil. The second thermostat is in communication with at least one of the second control valve, the second pump, and the second chilled beam or fan coil and is configured to selectively control at least one of the flow rates of cold water and/or hot water through the second control valve, the second pump, and the second chilled beam or fan coil. The third thermostat is in communication with at least one of the third control valve, the third pump, and the third chilled beam or fan coil and is configured to selectively control at least one of the flow rates of cold water and/or hot water through the third control valve, the third pump, and the third chilled beam or fan coil, and the fourth thermostat is in communication with at least one of the fourth control valve, the fourth pump, and the fourth chilled beam or fan coil and is configured to selectively control at least one of the flow rates of cold water and/or hot water through the fourth control valve, the fourth pump, and the fourth chilled beam or fan coil.

Another exemplary implementation of the present disclosure includes a method for controlling the water distribution in systems used in at least one of a heating, ventilation, air conditioning, refrigeration, fluid heating and chilling configuration, the method including the steps of: providing a cold water supply line and a hot water supply and at least one fan coil or chilled beam device; providing at least one control valve having: a cold water inlet in fluid communication with and configured to receive cold water from the cold water supply line; a cold water outlet in fluid communication with and configured to supply cold water to the cold water supply line; a cold water output in fluid communication with and configured to supply cold water from the cold water supply to the fan coil or chilled beam device; a cold water return inlet in fluid communication with and configured to receive from the fan coil or chilled beam device the cold water supplied by the cold water output and outputting the cold water to the cold water supply line via the cold water outlet; a hot water inlet in fluid communication with the hot water supply line; a hot water return outlet in fluid communication with the hot water supply line; a hot water output in fluid communication with and configured to supply hot water from the hot water supply to the fan coil or chilled beam device; and a hot water return inlet in fluid communication with and configured to receive from the fan coil or chilled beam device the hot water supply line via the hot water return outlet. Additional steps include providing a pump in fluid communication with the cold water output and the hot water output of the control valve fan coil or chilled beam; and providing a thermostat in communication with at least one of the control valve, the pump, and the fan coil or chilled beam and configured to selectively control at least one of the flow rates of cold water or hot water through the control valve, the pump, and the fan coil or chilled beam. Further steps include supplying cold water from the cold water output to the fan coil or chilled beam device; receiving into the cold water return inlet the cold water supplied by the cold water output to the fan coil or chilled beam device and outputting the cold water to the cold water supply line via the cold water outlet; supplying hot water from the hot water output for the fan coil or chilled beam device; and receiving into the hot water return inlet the hot water supplied by the hot water output to the fan coil or chilled beam device and outputting the hot water to the hot water supply line via the hot water outlet.

In various exemplary implementations of the present disclosure, systems and methods are provide which in essence move heat energy from one place to another, in that the heat picked up by the cold water return flows can be used in a heat recovery chiller (HRC) to heat the hot water supplied by the HRC to the system, which in turn, is used to heat a desired space and/or fluid. The looped nature of exemplary implementations of the disclosure thus tend to potentially reduce overall energy consumption. For example, in cooling a computer room with a fan coil or chilled beam, the cold water picks heat in the computer room and returns with that heat to the HRC, and the HRC then takes that heat and it transfers it from the "cold side" of the HRC to the "hot side" of the HRC, so that such heat is in the hot water circuit or loop and is available for use in heating a space and/or fluid.

While exemplary implementations of the systems and methods disclosed herein include the use of four control valves, four fan coil/chilled beams, four pumps, four thermostats, etc. for a four-zone space/fluid conditioning, it is to be understood that such systems and methods disclosed herein are not limited to conditioning four zones and could be used in connection with more or less zones and could have more or less control valves, fan coil/chilled beams, pumps, thermostats, etc. than discussed with the exemplary implementations in this disclosure.

In some exemplary implementations, the cold water supply and the hot water supply each include a heat recovery chiller and/or at least one of the chilled beams is an active chilled beam and the control valve devices are six-way control valves.

In additional exemplary implementations a housing is provided, which includes: the first control valve device, the second control valve device, the third control valve device, and the fourth control valve device; the cold water inlet, the cold water outlet, the cold water output, the cold water return, the hot water output, and the hot water return inlet; the first cold water tee, the second hot water tee, the second cold water tee, and the second hot water tee; and/or the first thermostat, the second thermostat, the third thermostat, and the fourth thermostat.

BRIEF DESCRIPTION OF THE DRAWINGS

Figure 1A:
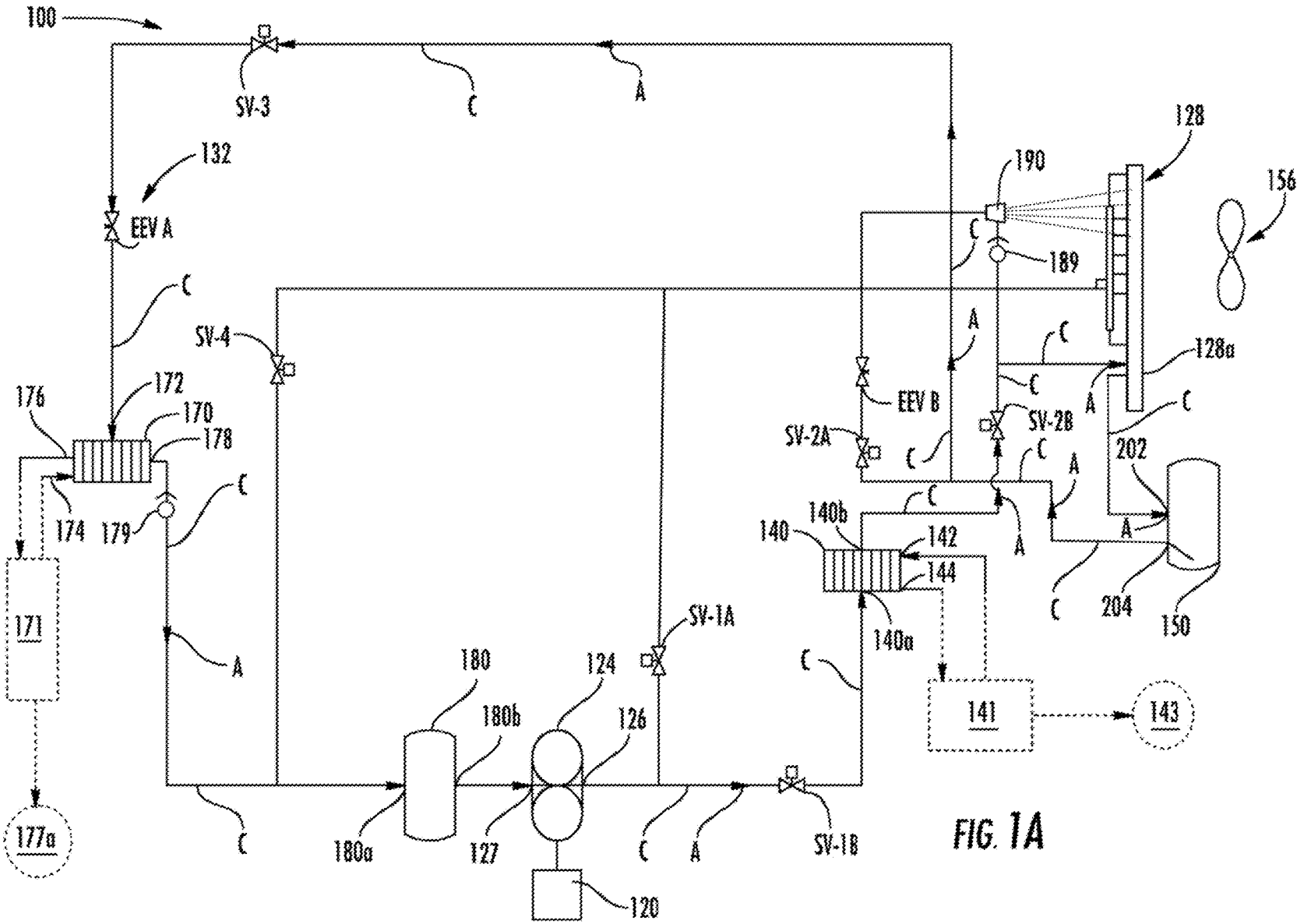

Having thus described exemplary implementations of the disclosure in general terms, reference will now be made to the accompanying drawings, which are not necessarily drawn to scale, and which form a part of the specification. Features shown in the drawings are meant as illustrative of some, but not all, exemplary implementations of the present disclosure, unless otherwise explicitly indicated, and implications to the contrary are otherwise not to be made. Although in the drawings like reference numerals correspond to similar, though not necessarily identical, components and/or features, for the sake of brevity, reference numerals or features having a previously described function may not necessarily be described in connection with other drawings in which such components and/or features appear.

Figure 1B:
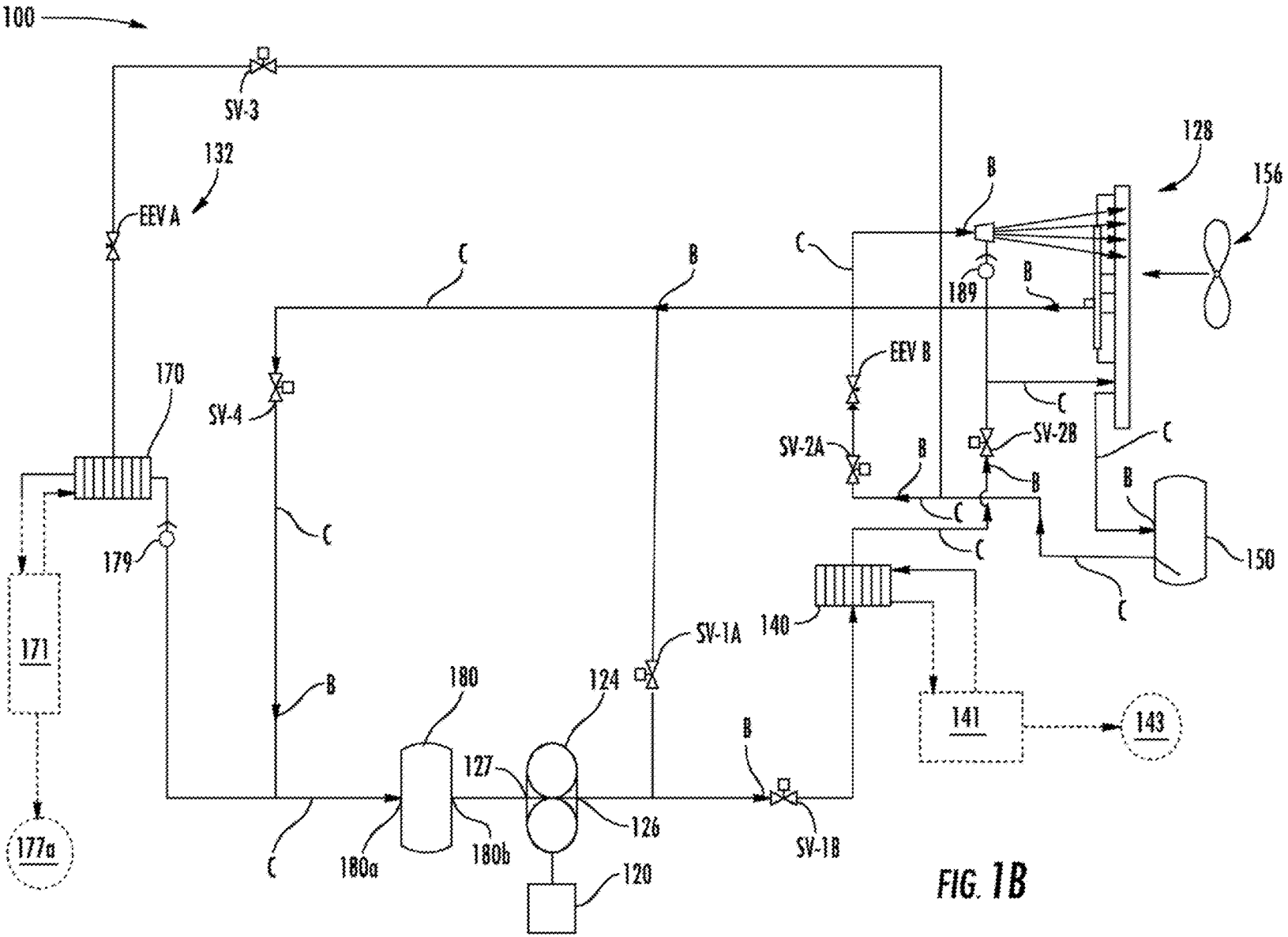
Figure 1C:
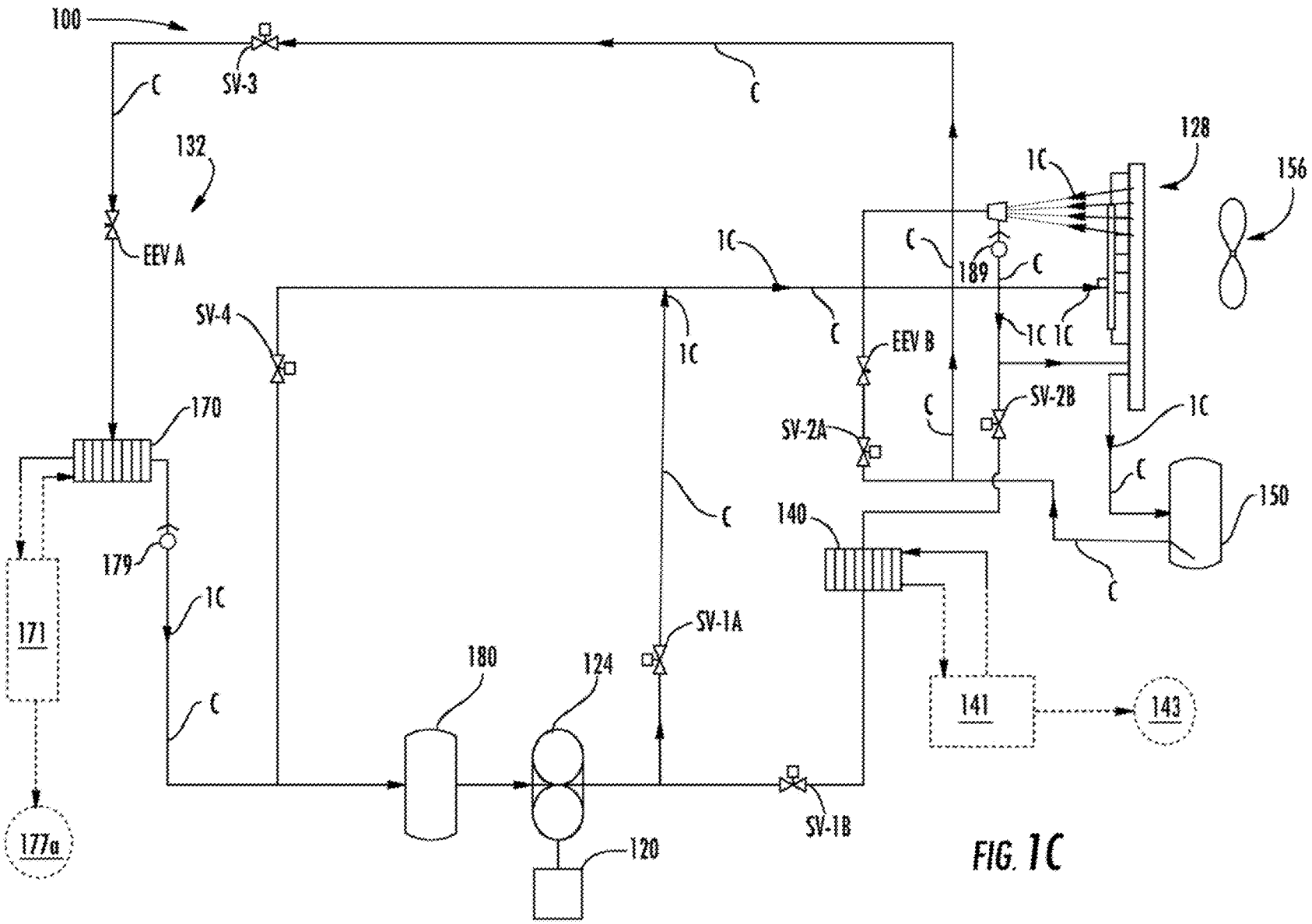
Figure 1D:
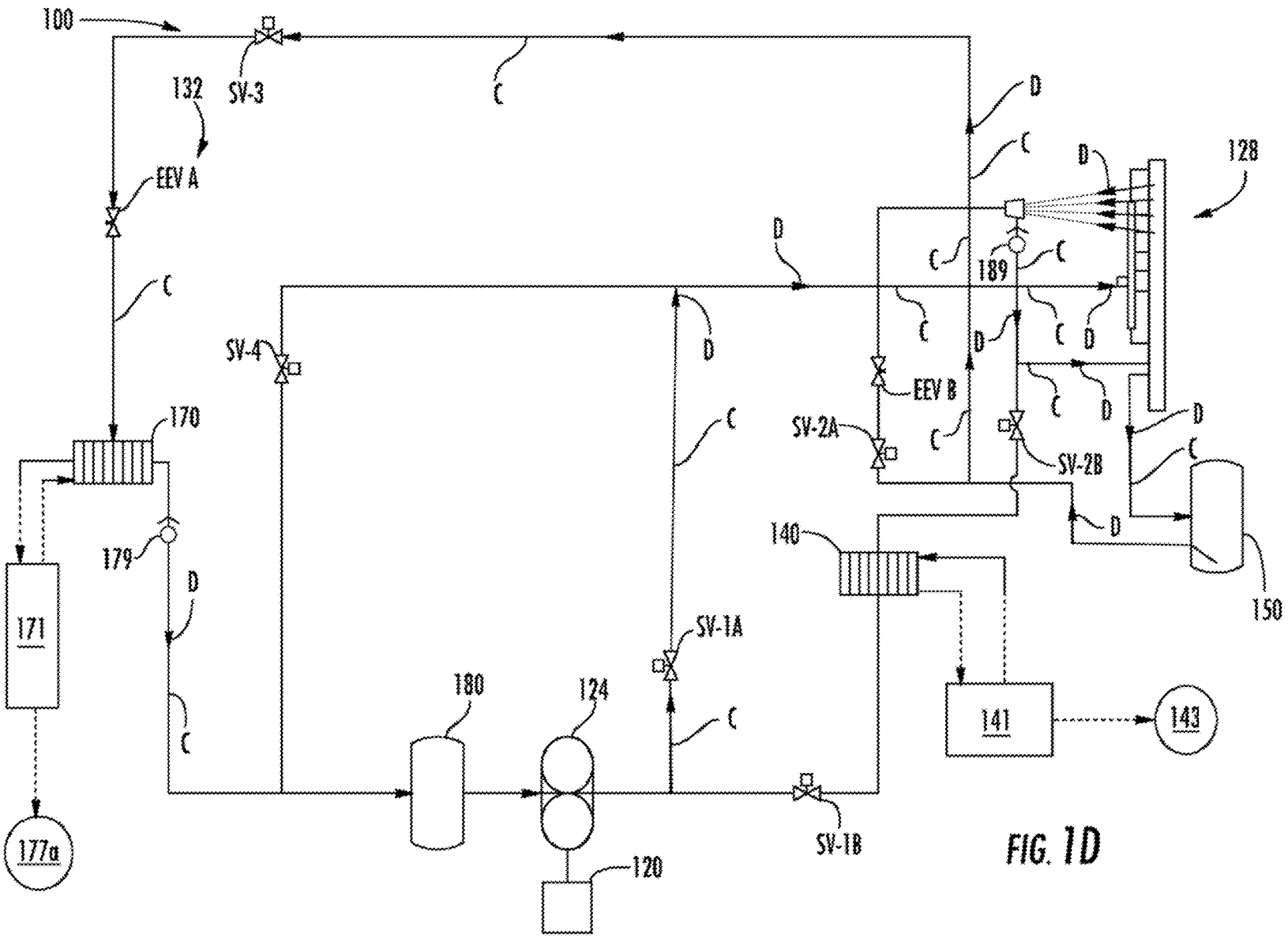
Figure 1E:
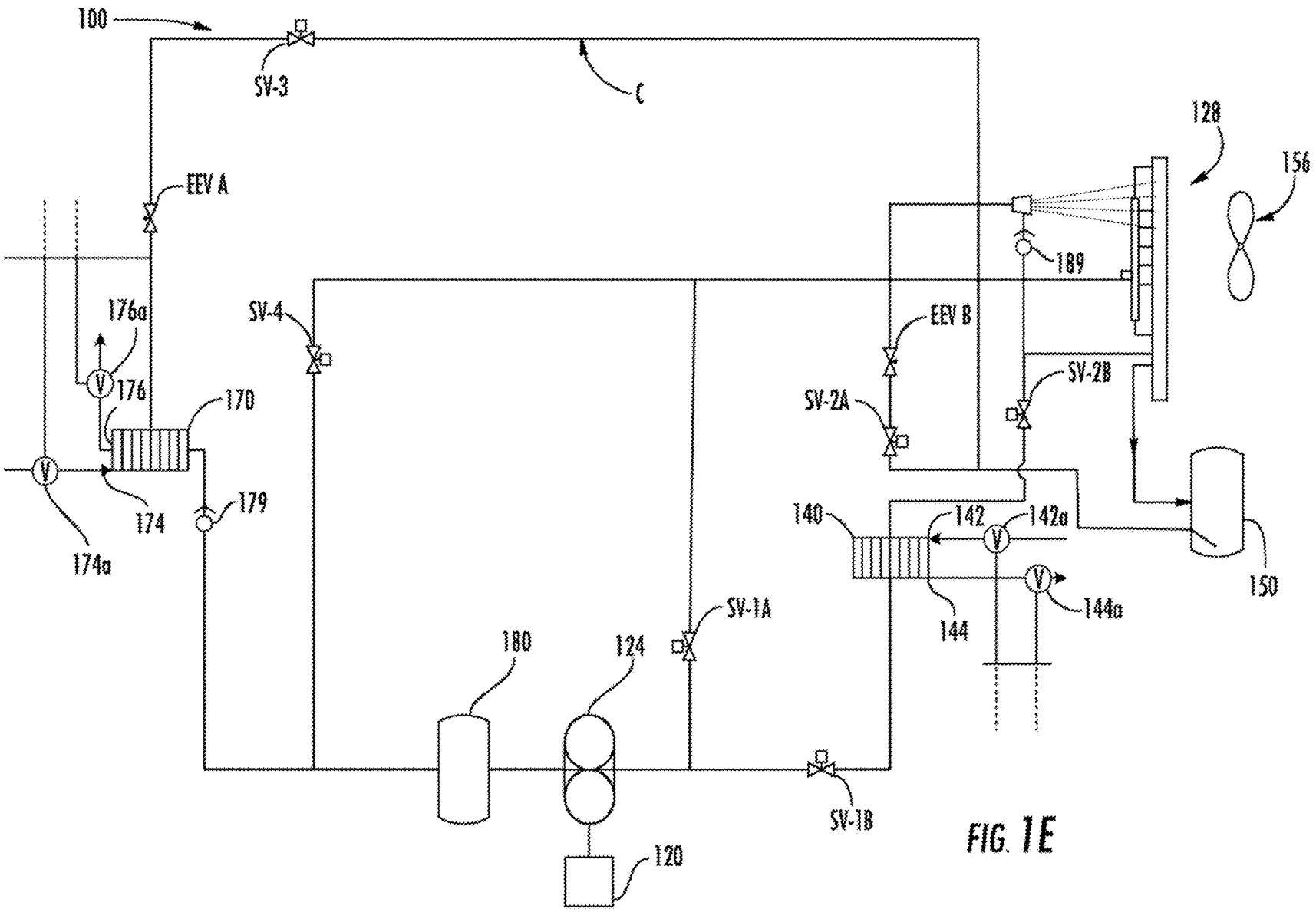
Figure 2:
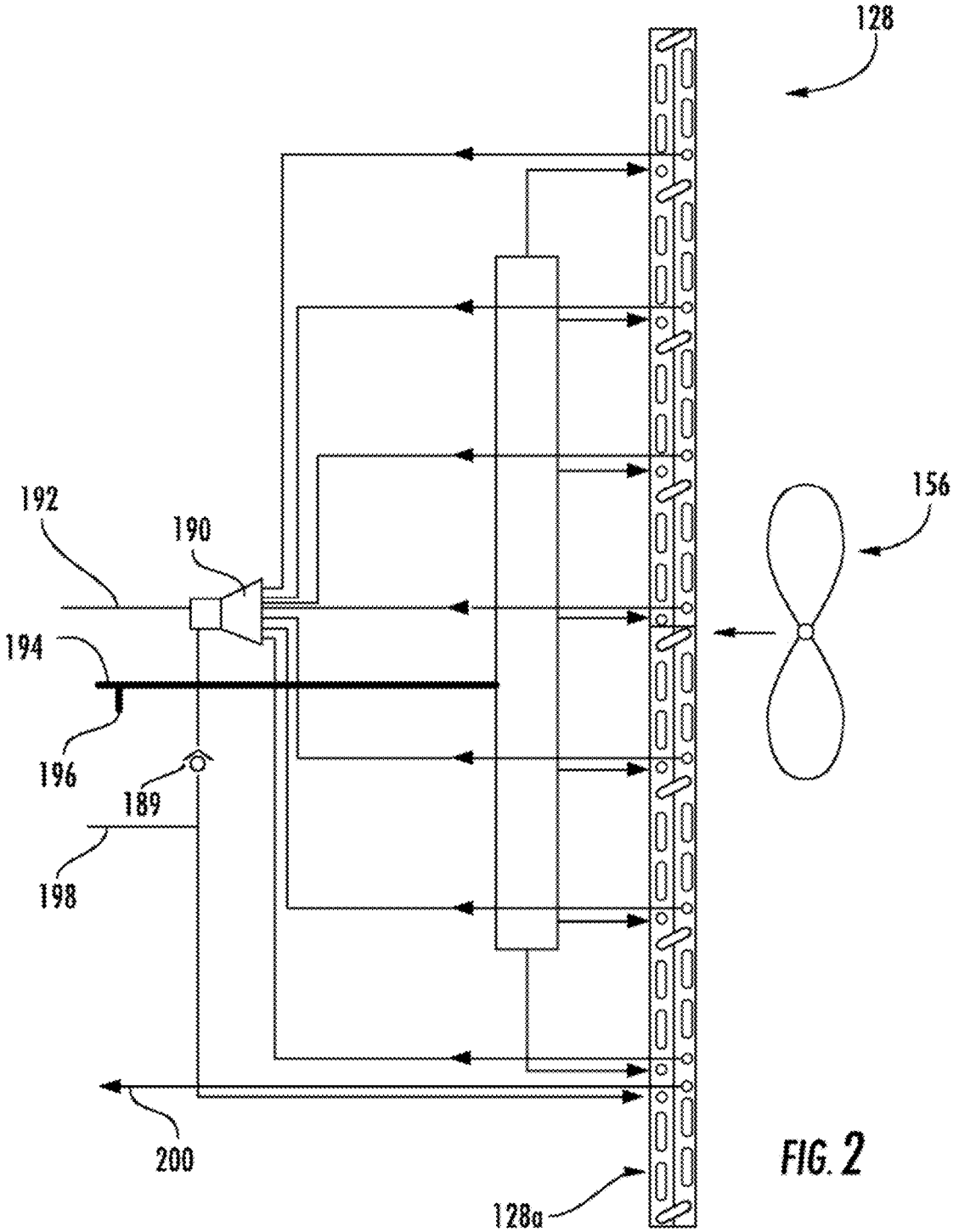
Figure 3:
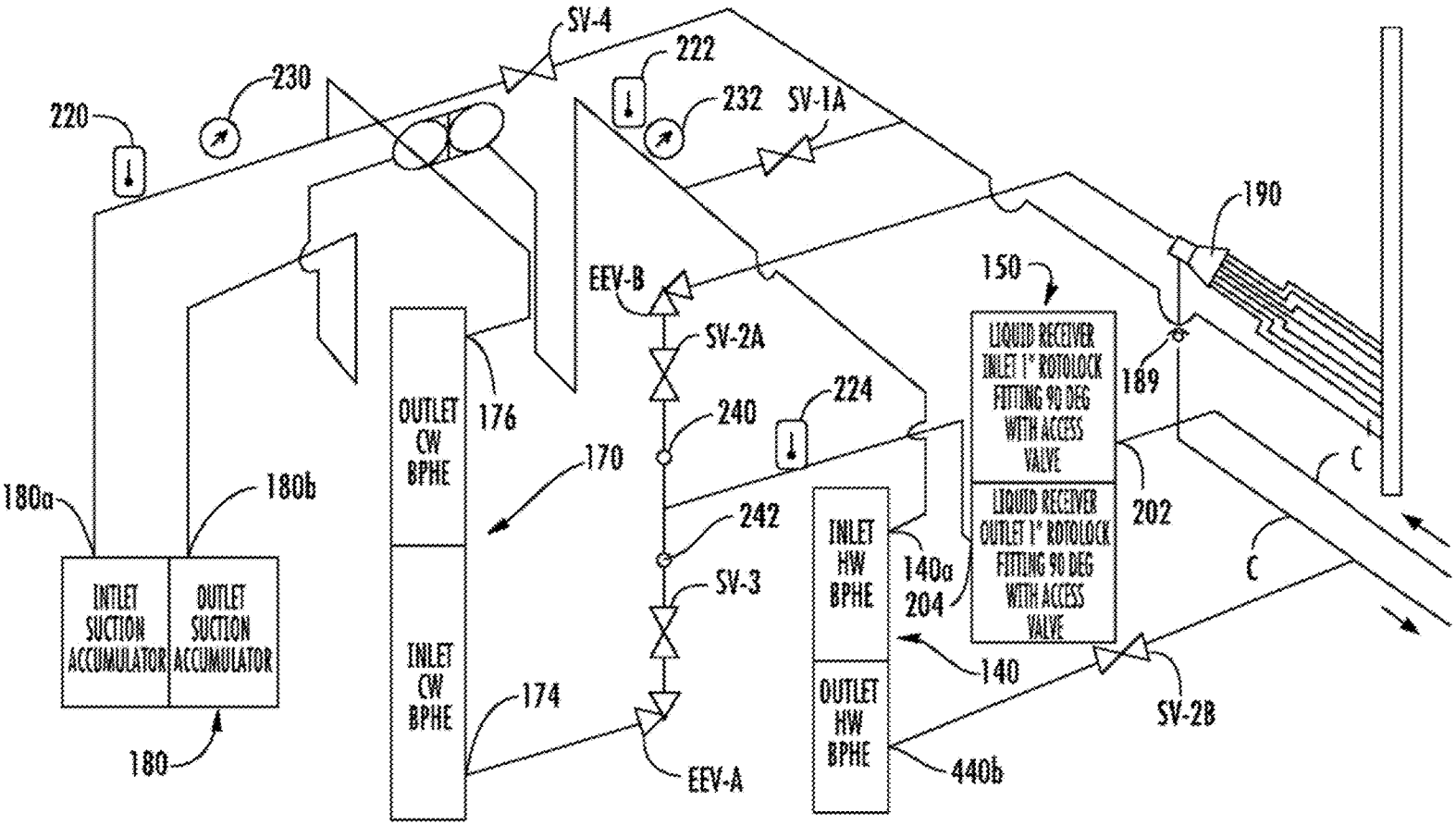
Figure 5:
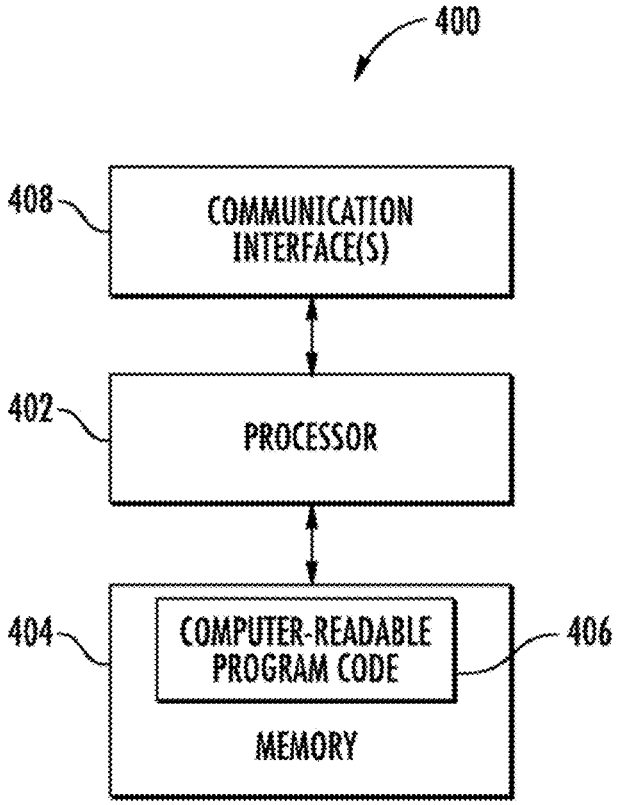
Figure 6:
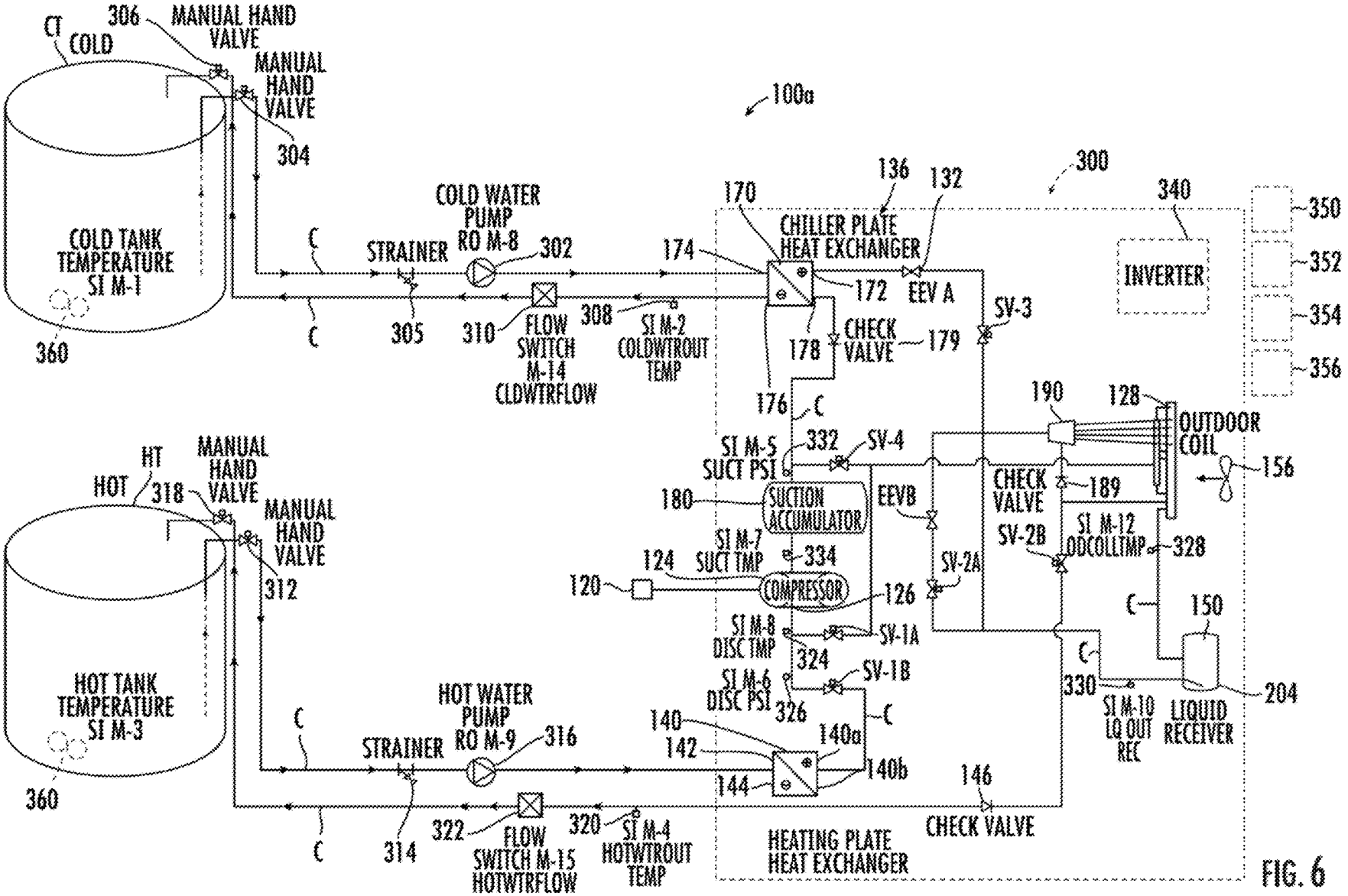
Figure 7:
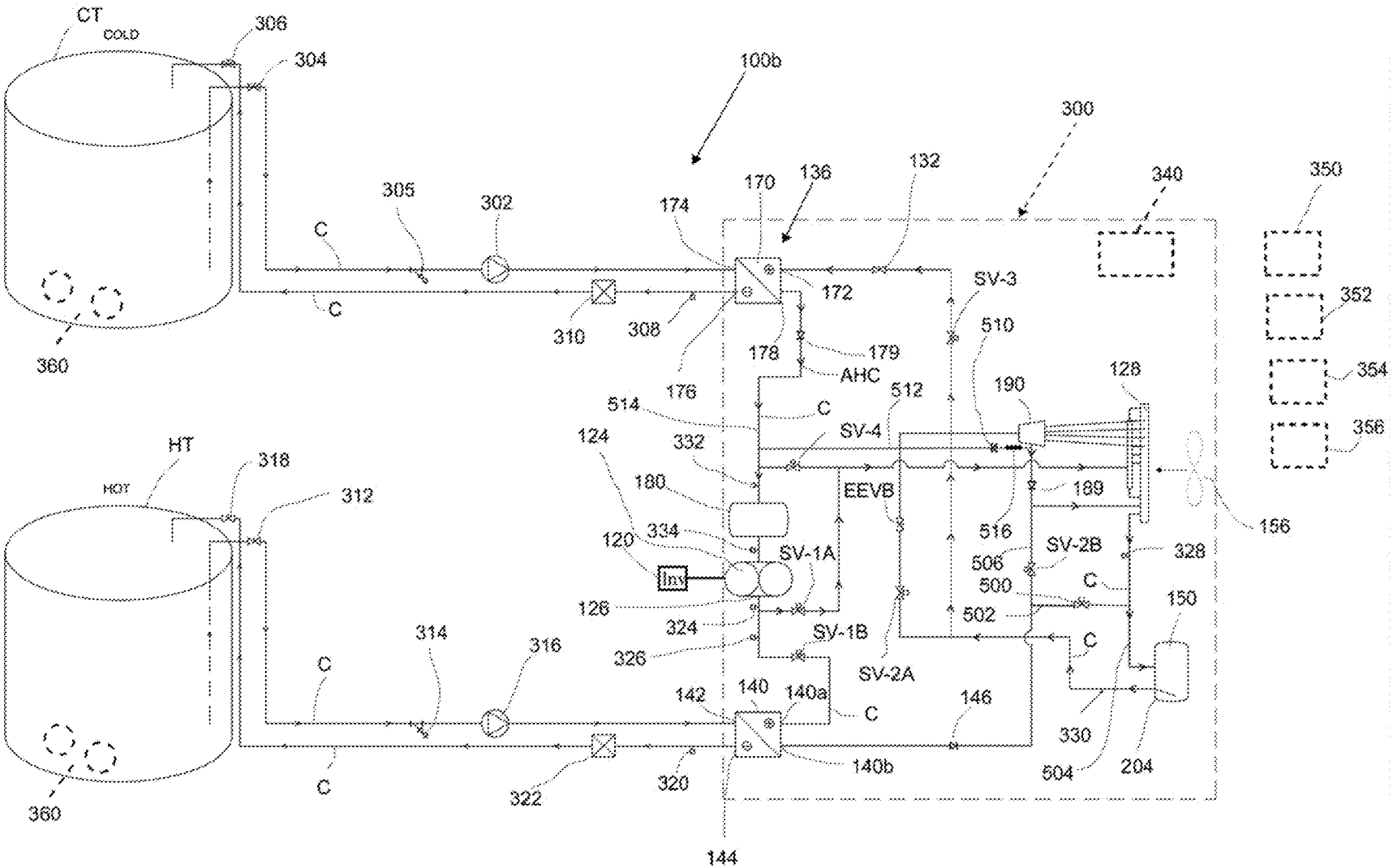
Figure 8:
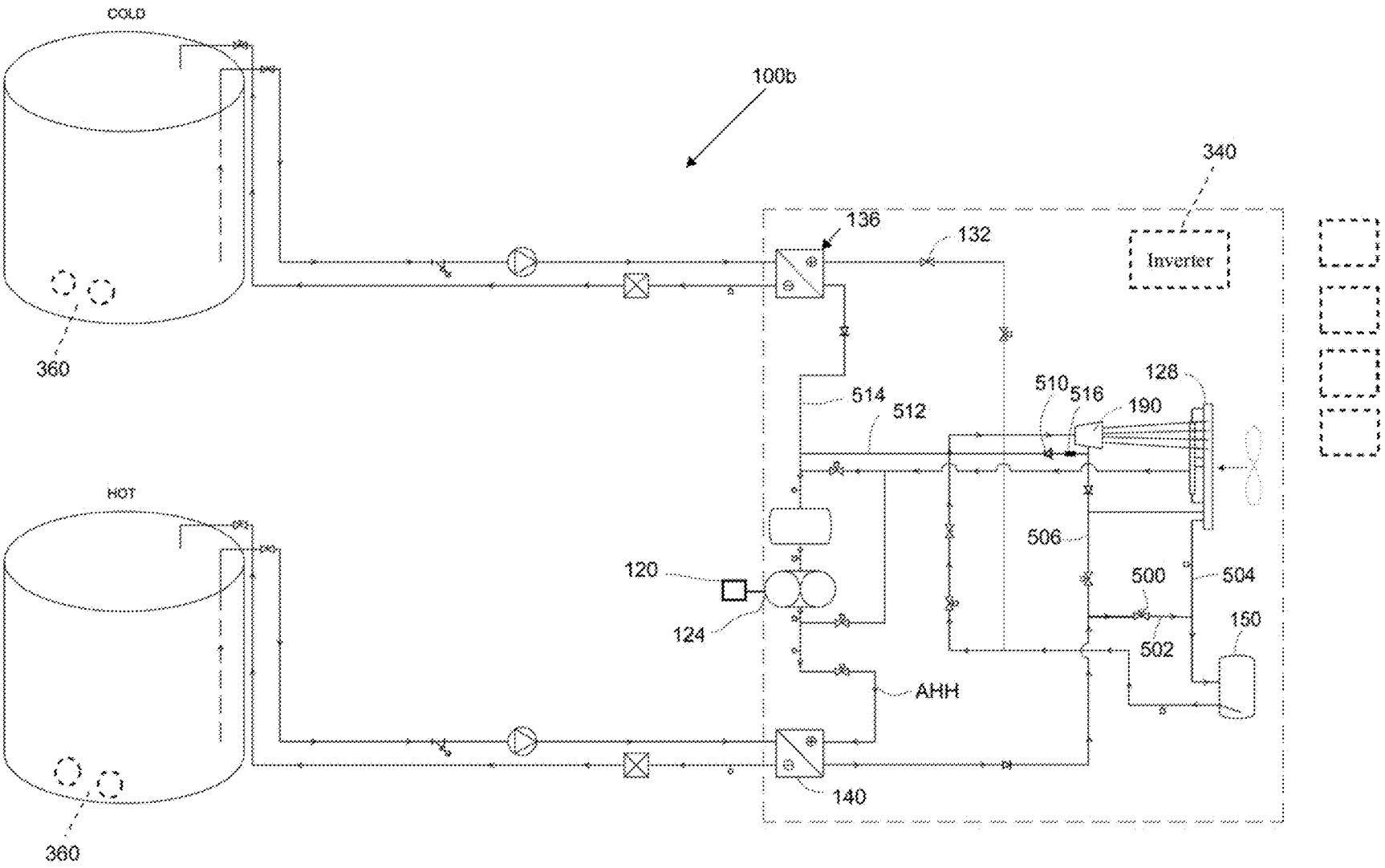
Figure 9:
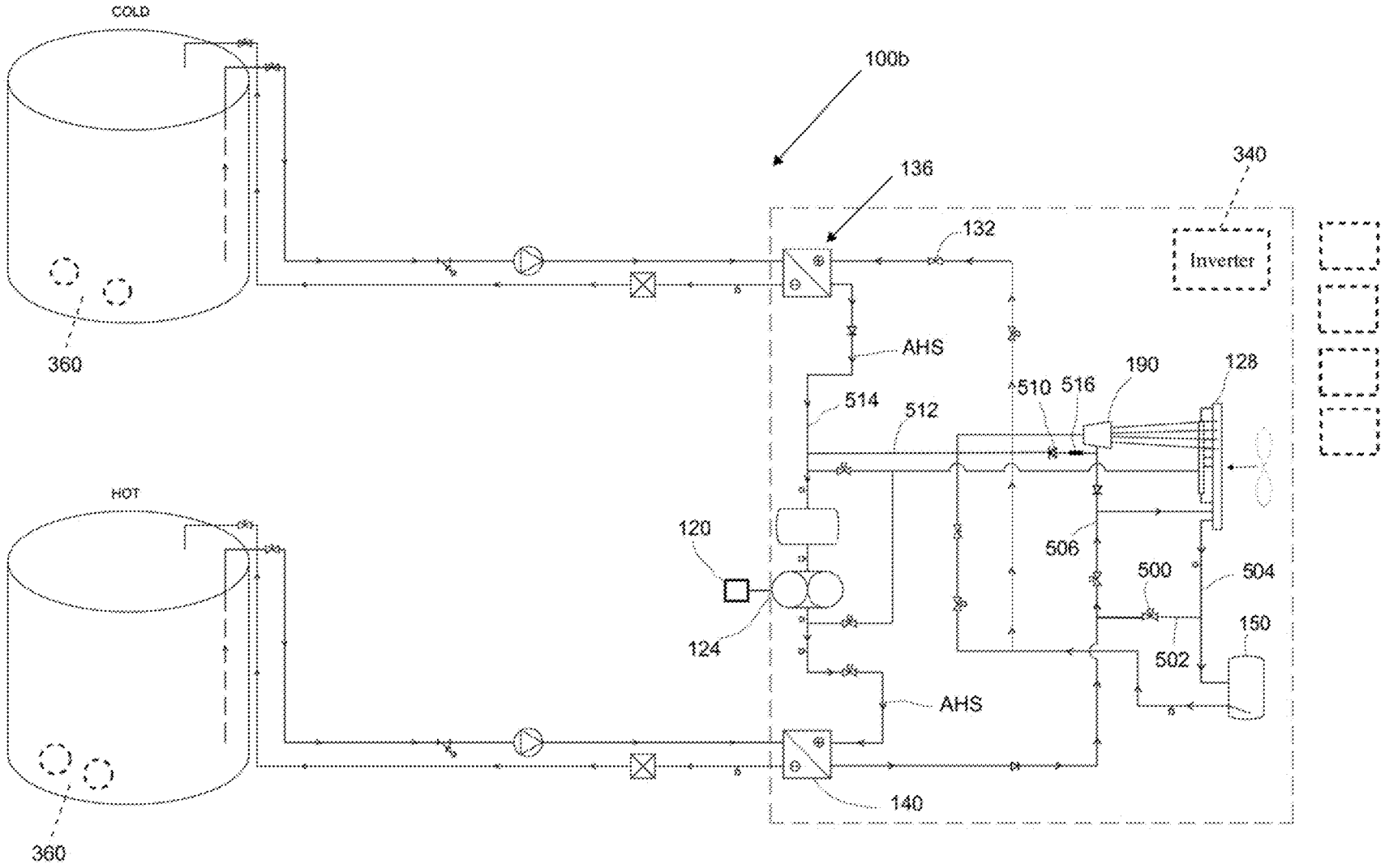
Figure 10:
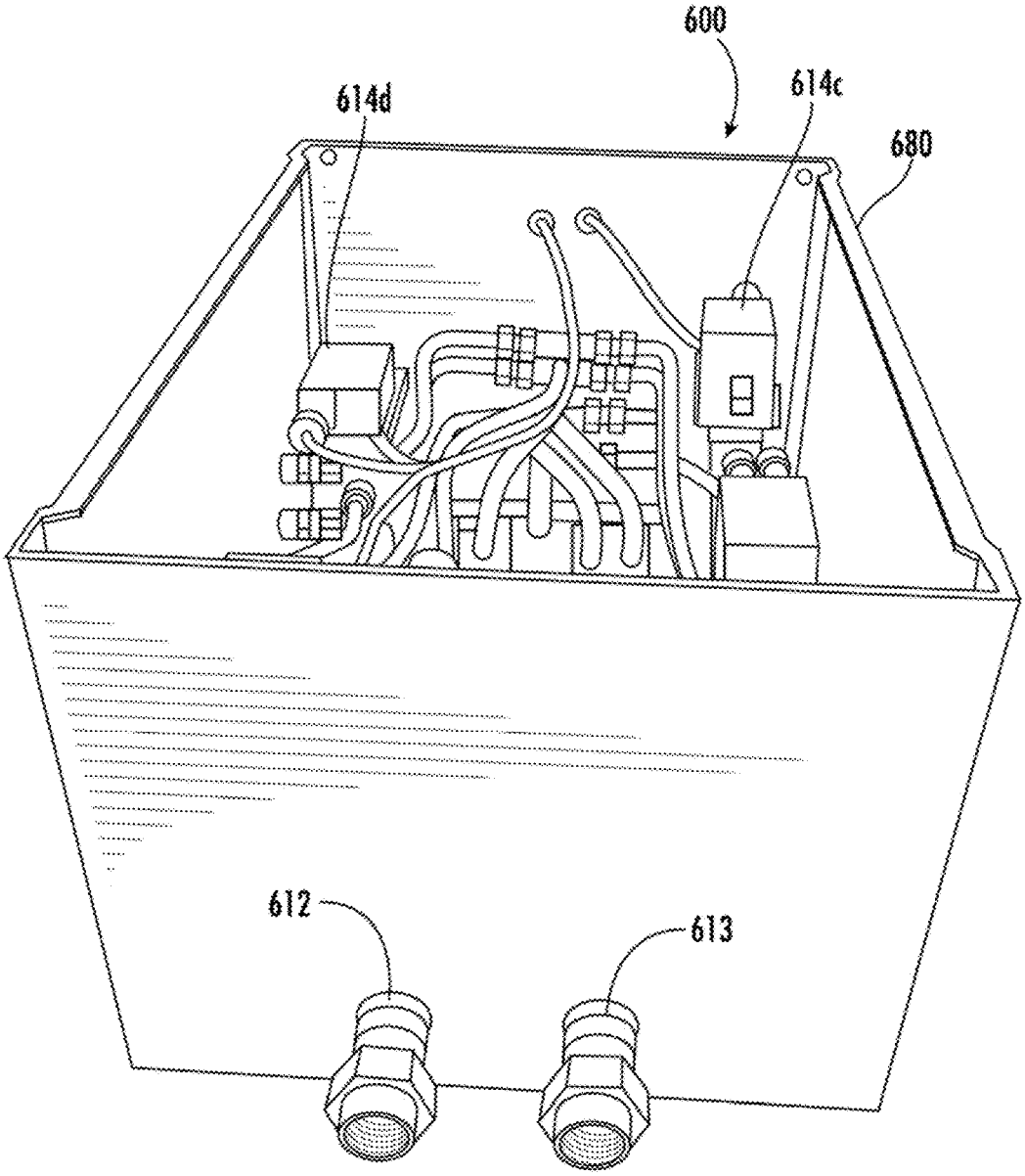
Figure 11:
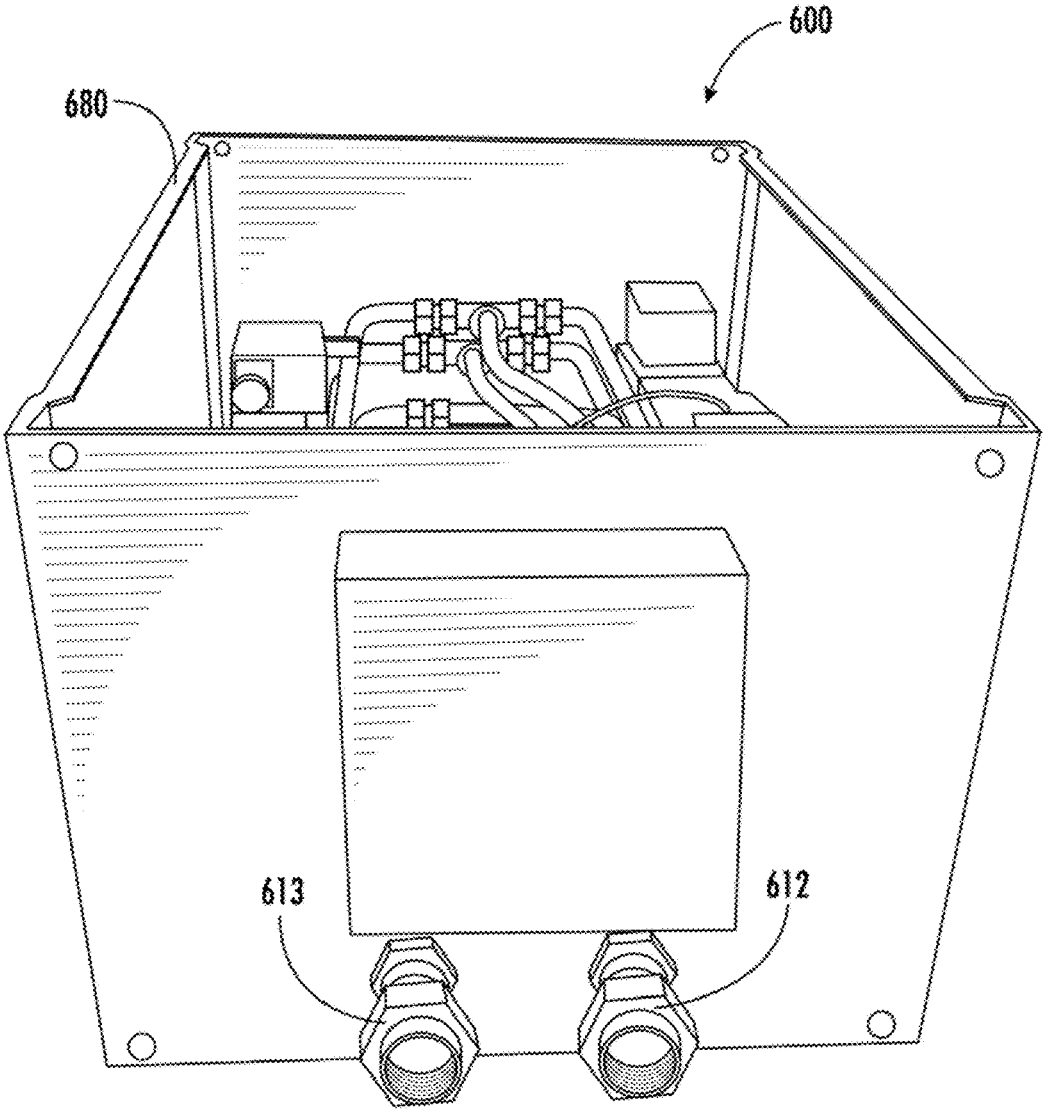
Figure 12:
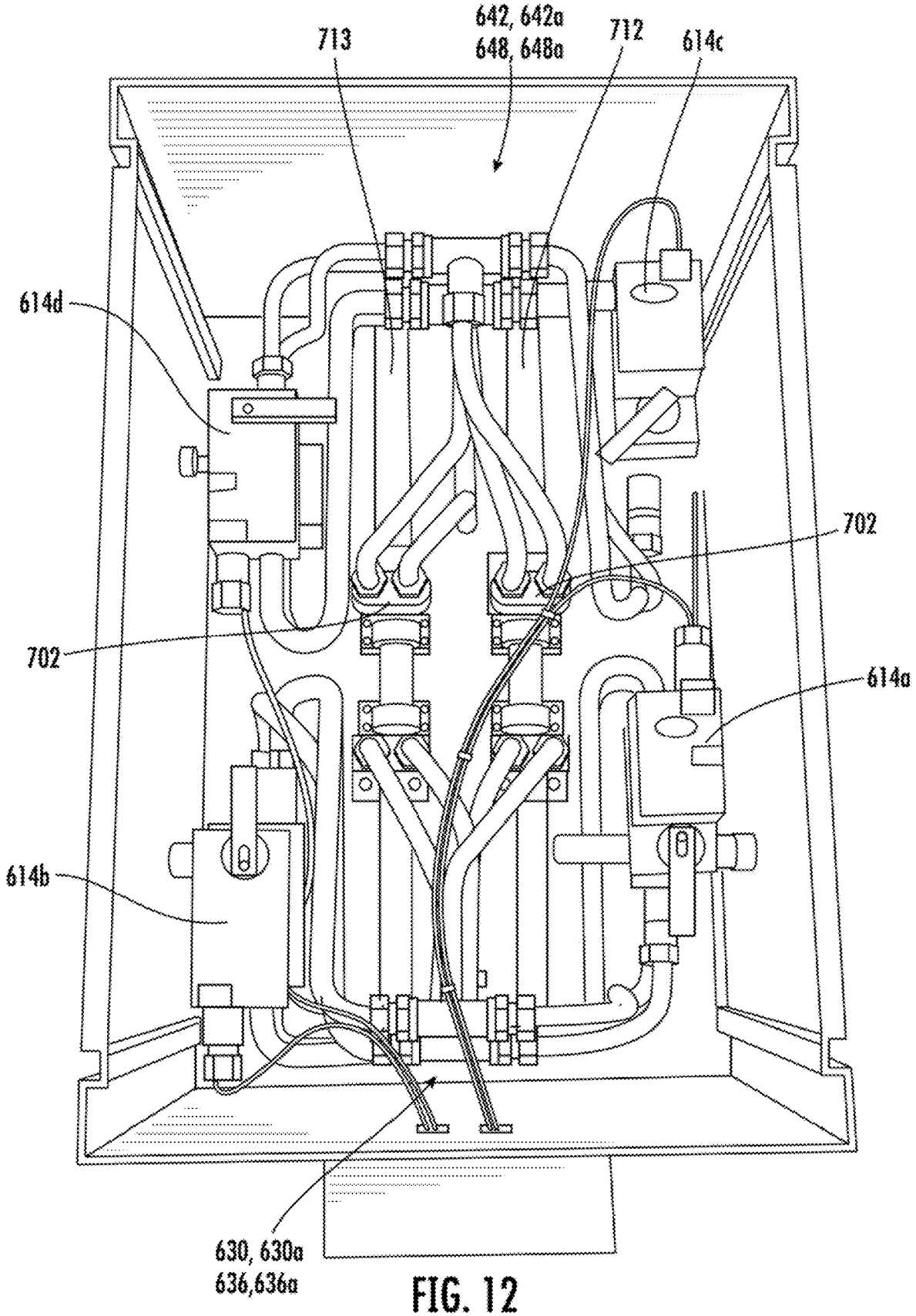
Figure 13:
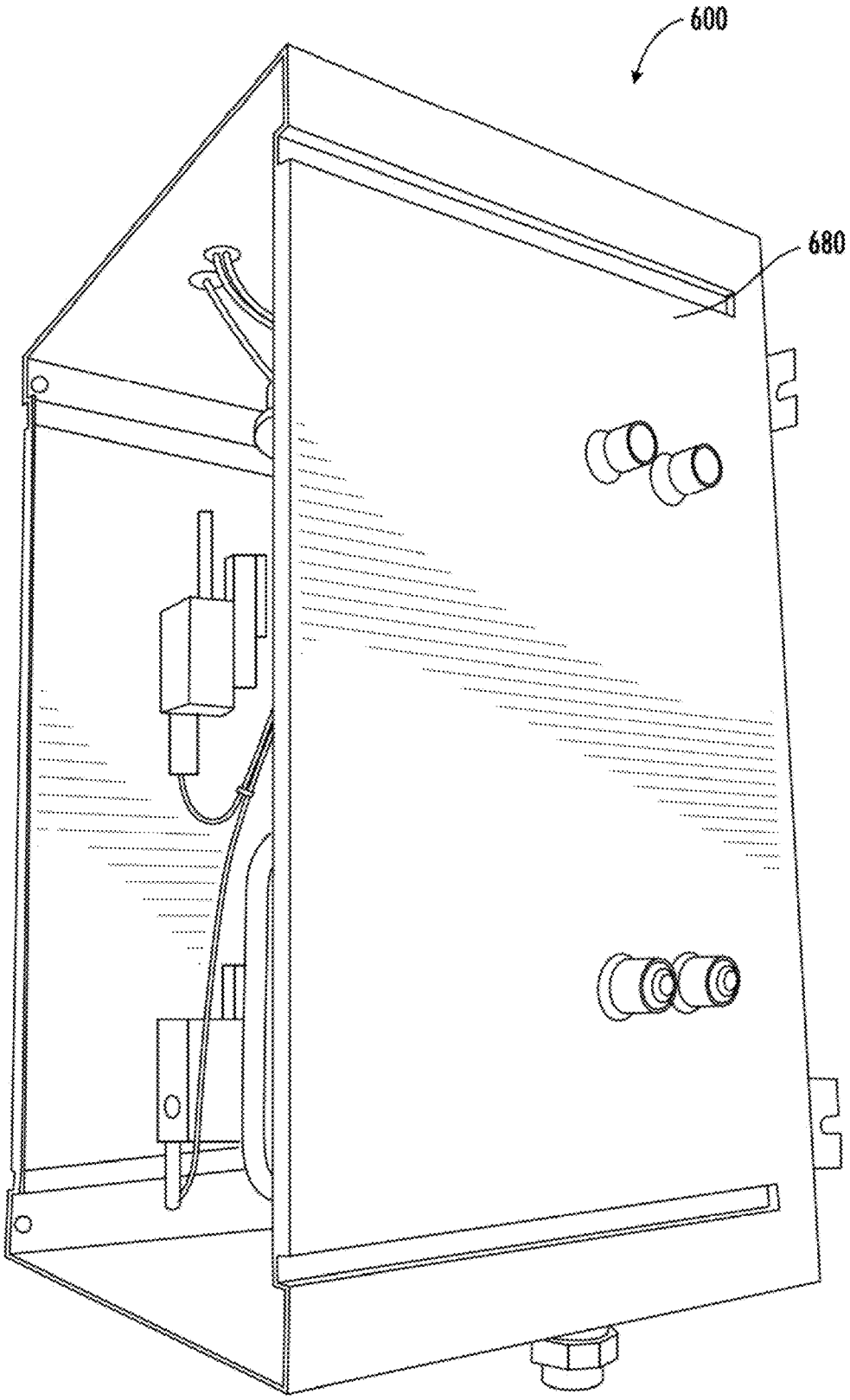
Figure 14:
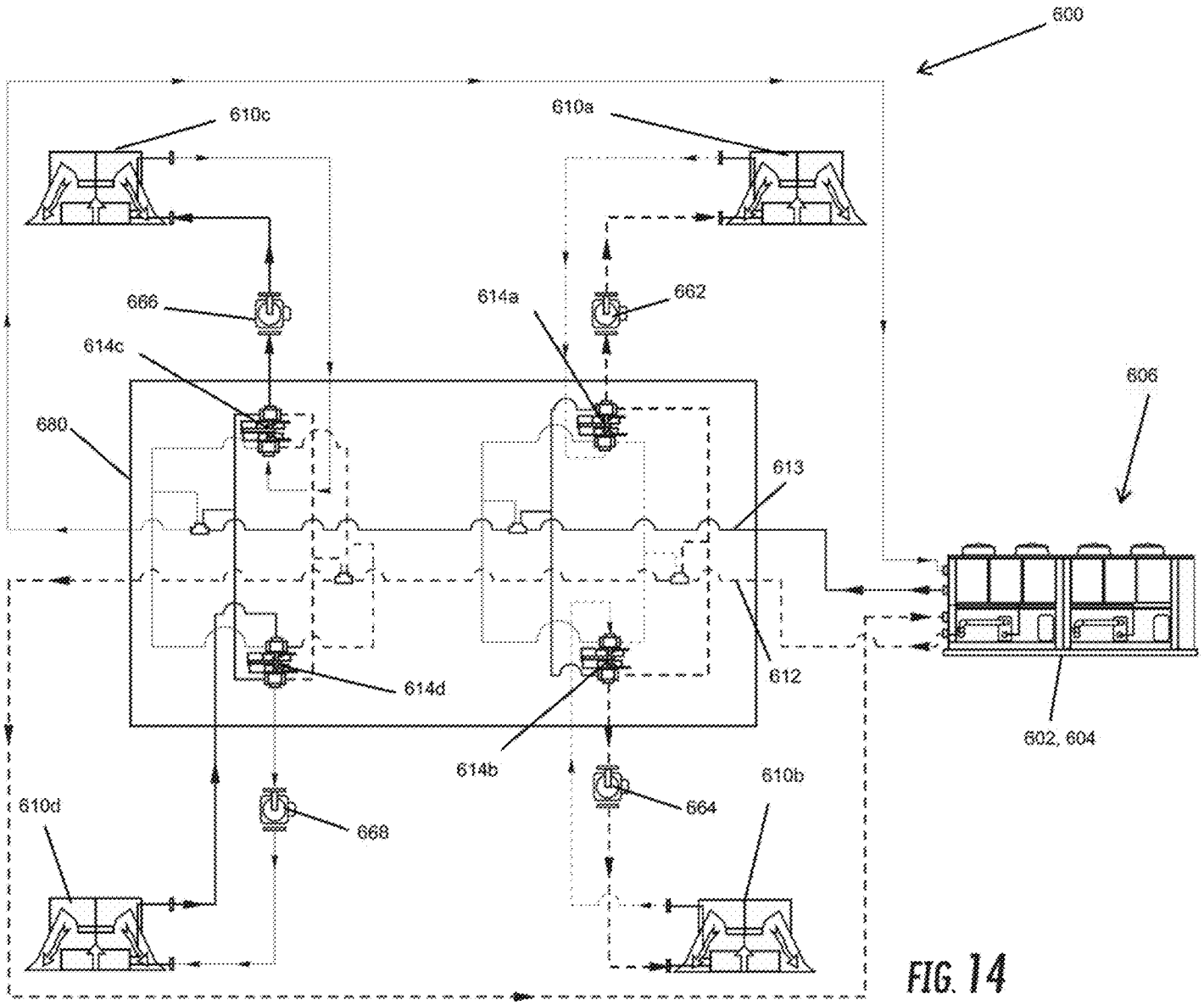
Figure 15:
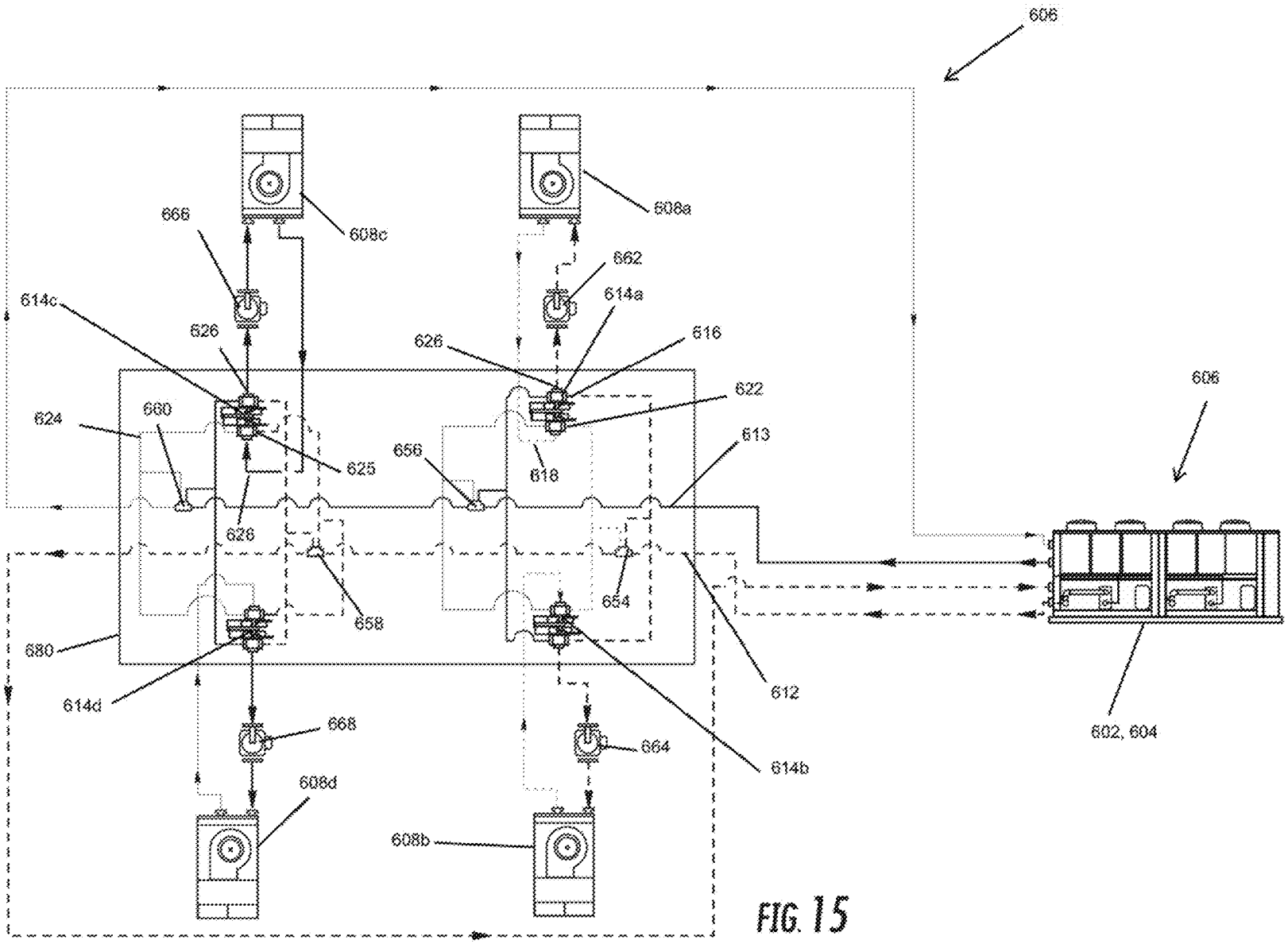

FIG. 1A is a schematic diagram of a heat source optimization system according to one or more examples of the present disclosure in a substantially simultaneous heating and cooling configuration or mode;

FIG. 1B is a schematic diagram of a heat source optimization system according to one or more examples of the present disclosure in a mode for producing hot water and/or a heated secondary fluid;

FIG. 1C is a schematic diagram of a heat source optimization system according to one or more examples of the present disclosure in a mode for producing chilled water and/or a cooled secondary fluid;

FIG. 1D is a schematic diagram of a heat source optimization system according to one or more examples of the present disclosure in a substantially defrosting mode;

FIG. 1E is a schematic diagram of a heat source optimization system according to one or more examples of the present disclosure in a mode using groundwater and/or one or more earth (ground) loops;

FIG. 2 is a schematic diagram of a condenser portion of a heat source optimization system according to one or more examples of the present disclosure;

FIG. 3 is a schematic diagram of a portion of a heat source optimization system according to one or more examples of the present disclosure;

FIG. 4 illustrates a table including various operations in a heat source optimization system according to one or more examples of the present disclosure. As shown, the method may include a number of operations performed continuously in real-time during operation of such heat source optimization system;

FIG. 5 illustrates an apparatus that according to some examples may be configured to at least partially implement a controller system in accordance with example implementations;

FIG. 6 illustrates a schematic diagram of an alternate implementation of a heat source optimization system according to one or more examples of the present disclosure;

FIG. 7 illustrates a schematic diagram of another alternate implementation of a heat source optimization system according to one or more examples of the present disclosure, such implementation being shown in a cooling mode;

FIG. 8 illustrates the alternate implementation of a heat source optimization system shown in FIG. 7, in a cooling mode;

FIG. 9 illustrates the alternate implementation of a heat source optimization system shown in FIG. 7, in a simultaneous heating and cooling mode;

FIG. 10 illustrates a photographic view of an exemplary implementation of a valve system according to the present disclosure from a first end;

FIG. 11 illustrates a photographic view of an exemplary implementation of a valve system according to the present disclosure from a second end, generally opposite from the first end;

FIG. 12 illustrates a photographic view of an exemplary implementation of a valve system according to the present disclosure from a first side;

FIG. 13 illustrates a photographic view of an exemplary implementation of a valve system according to the present disclosure from a second end, generally opposite from the first side;

FIG. 14 illustrates a schematic diagram of an implementation of valve system according to one or more examples of the present disclosure in use with one or more fan coils; and FIG. 15 illustrates a schematic diagram of an implementation of valve system according to one or more examples of the present disclosure in use with one or more active chilled beams.

Each figure shown in this disclosure shows a variation of an aspect of the implementations presented, and only differences will be discussed in detail.

DESCRIPTION OF EXAMPLE IMPLEMENTATIONS

The accompanying drawings and the description which follows set forth example implementations of the present disclosure. However, it is contemplated that persons generally familiar with heat pump systems will be able to apply the novel characteristics of the structures illustrated and described herein in other contexts by modification of certain details. Accordingly, the drawings and description are not to be taken as restrictive on the scope of the present disclosure, but are to be understood as broad and general teachings.

Reference herein to "one example" means that one or more feature, structure, or characteristic described in connection with the example is included in at least one implementation. The phrase "one example" in various places in the specification may or may not be referring to the same example.

Illustrative, non-exhaustive examples, which may or may not be claimed, of the subject matter according the present disclosure are provided below.

Some implementations of the present disclosure will now be described more fully hereinafter with reference to the accompanying drawings, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art. Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of one or more other items, e.g., a "first" or lower-numbered item, and/or, e.g., a "third" or higher-numbered item. Further, although reference may be made herein to a number of measures, predetermined thresholds and the like such as times, distances, speeds, temperatures, flow rates, voltages, power, coefficients, pressures, humidities, percentages and the like, according to which aspects of example implementations may operate; unless stated otherwise, any or all of the measures/predetermined thresholds may be configurable. Like reference numerals refer to like elements throughout.

As used herein, "and/or" means any one or more of the items in the list joined by "and/or." Further, as used herein, the term "example" and "exemplary" means serving as a non-limiting sample, implementation, instance, or illustration. Moreover, as used herein, the term, for example, or "e.g.," introduces a list of one or more non-limiting examples, instances, or illustrations.

Referring now to the figures, there are illustrated example heat source optimization systems in accordance with at least one implementation described herein. FIGS. 1A-1E illustrate an exemplary heat source optimization system, generally 100 (which may be referred to herein simply as "system 100") in accordance with aspects of the present disclosure.

In this example, the heat source optimization system 100 includes at least one motor, generally and collectively 120, drivingly connected to at least one compressor, generally and collectively 124. Compressor 124 is connected (for fluid flow, communication, or transfer, via a piping, or conduit, system, generally C) to at least one condenser device, generally and collectively 128, at least one expansion valve or device, generally and collectively 132, and at least one evaporator device, generally and collectively 136. Conduit system C connects compressor 124, condenser 128, expansion valve 132, and evaporator 136 in a loop that allows refrigerant to repeatedly cycle through system 100.

Generally, compressor 124 compresses a refrigerant or primary fluid, when such refrigerant is in the gaseous or vapor state. Such pressurized gaseous refrigerant leaves the discharge side 126 of compressor 124 in a relatively hot, highly pressurized state. Such hot gas flows through condenser 128, where the gas condenses into a relatively high pressure substantially liquid state or phase, with its temperature having been reduced somewhat. This condensed liquid refrigerant then ultimately passes through a pressure-lowering device, such as an expansion valve 132, whereby the pressure of such refrigerant is lowered, and its temperature lowered accordingly, prior to its flow into evaporator 136, wherein the refrigerant absorbs heat energy to the point that it returns to a gaseous state. The refrigerant in such gaseous state then returns to the inlet side 127 of compressor 124, and the cycle of the refrigerant through system 100 may then be repeated.

In instances where system 100 is used to heat and/or cool a space, such as a residence, swimming pool, spa, office, vehicle, vessel, commercial and/or industrial establishment or process, system 100 will in most cases ordinarily be positioned outside of such space. System 100 operates under the control of one or more processors or controllers (also hereafter referred to collectively as "controller system") (FIG. 5), in a controller system, generally 400.

Although not illustrated, control configuration 400 includes wiring or wireless connections associated or connected therewith for communicating with communication interfaces 408 having input/output circuitry for receiving sensed signals from sensors, transducers, and the like and also interface circuitry for outputting control signals for controlling the various components, including without limitation valving, motor 120, compressor 124, condenser 128, expansion valve 132, and evaporator 136, as discussed herein.

System 100 is shown in FIGS. 1A-1E in various modes of operation. In FIG. 1A, system 100 is illustrated in a configuration, or mode (FIG. 4), for permitting substantially simultaneous heating and cooling of a secondary fluid, such as water, glycol, a mixture of same, or other suitable fluid. In such mode, the refrigerant or primary fluid, exiting the discharge side 126 of compressor 124 is, as noted above by arrows A, in a pressurized, hot, gaseous state. Such refrigerant is permitted to pass through conduit system C through an open valve SV-1B (which could be connected to controller system 400 and a valve such as a solenoid valve, electric motor-controlled valve, manual valve, etc.), and then onward through a hot brazed plate, generally 140.

In passing through hot brazed plate 140, the refrigerant becomes a relatively high pressure gas of somewhat less temperature, in that it is cooled somewhat in hot brazed plate 140, and thus gives up some of its energy, to water or other secondary fluid passing through the hot brazed plate 140. The secondary fluid, which could be portable water, enters hot brazed plate 140 at inlet 142 and exits at output 144, being heated as it passes through hot brazed plate 140. From outlet 144, the heated secondary fluid could be used directly in an application calling for use of such heated secondary fluid, or, in the case of the secondary fluid being potable water, it could be used directly in an application calling for such heated potable water. Although not shown, hot brazed plate 140 could include one or more sensors for sensing flow rate, pressure, time and/or temperatures, etc. of both refrigerant and secondary fluid flowing therethrough. It is to be understood that secondary fluid passing through hot brazed plate 140 may be potable water, or may function as a fluid that goes to heat a space or for other purposes or to a secondary heat exchanger 141 which could be used to heat a space, swimming pool, spa, industrial process, etc., or to heat a potable water at a supply location, generally 143. If the secondary fluid is to be used for heating a space, swimming pool, spa, industrial process, etc., then such fluid could be water, glycol, a combination thereof, or some other suitable secondary fluid, which is preferably non-toxic, such that in the event of a leak at heat exchanger 141 or otherwise, the likelihood of such leak posing a health concern would be reduced. It should also be understood here that heat exchangers other than hot brazed plate 140 could be used if desired. It is also to be understood that secondary fluid passing through hot brazed plate 140 may be connected in parallel or in series to multiple applications where heated water is desired, such as a heat exchanger for space heating, water tanks, one or more potable hot water heater, a swimming pool, a spa, one or more commercial and/or industrial processes, a cooling tower, etc. For example, the heated secondary fluid could be used for potable hot water for so long as such hot water heater called for heat, and once that need was met, the heated secondary fluid could then be diverted to heat a swimming pool and/or spa. Alternately, such water heater and such swimming pool and/or spa could receive the heated secondary fluid simultaneously, if desired. Controller system 400 could also be configured to select the better place from which to pull heat. For example, if a heated swimming pool is available, but such heated water is not critical to have, controller system 400 could be configured to optimize the efficiency of operation of system 100 by pulling heat from such swimming pool rather than the air and/or groundwater and/or a ground loop.

As used herein, "hot water" is water of a temperature generally greater than the temperature of the space and/or fluid to be heated or cooled, and "cold water" is water of a temperature generally less than the temperature of the space or fluid to be heated and/or cooled.

Upon exiting the discharge side 140*b* of hot brazed plate 140, the refrigerant passes through conduit system C through an open valve SV-2B (which could be connected to controller system 400 and a valve such as a solenoid valve, electric motor-controlled valve, manual valve, etc.) to condenser 128 (and/or to a subcooler 128*a* thereof) and then to a liquid refrigerant receiver, generally 150, where it may be stored for future use as determined by an operator manually or automatically by controller system 400. Subcooler 128*a* could form a part of condenser 128 or be separate therefrom. Condenser 128 includes condenser coils (not shown) and a fan 156 which may be selectively modulated by controller system 400 to maintain the desired temperature and/or pressure of refrigerant within condenser 128. Upon leaving subcooler 158*a* and/or receiver 150, the refrigerant passes via conduit system C through an open valve SV-3 (which could be connected to controller system 400 and a valve such as a solenoid valve, electric motor-controlled valve, manual valve, etc.) and through expansion valve 132. Expansion valve 132 could be electrically operated so that it may be selectively modulated between the opened and closed positions under the instruction of controller system 400. It is also to be understood that expansion valve 132 could be simple fixed expansion valve or an electronic or mechanical pressure and/or temperature-actuated expansion valve, if desired.

From expansion valve 132, the refrigerant passes on to evaporator 136, and more specifically, a chilled brazed plate, generally 170. After exiting expansion valve 132, the refrigerant, now in a cooled, low pressure liquid phase, enters the inlet side 172 of chilled brazed plate 170. Chilled brazed plate 170 also includes a secondary fluid inlet 174 and outlet 176 for chilling the secondary fluid, which could be water or water mixture for cooling a space and/or for providing chilled potable water. Upon the secondary fluid entering inlet 174, it has its heat energy absorbed therefrom by the refrigerant as such secondary fluid passes through chilled brazed plate 170 such that when the secondary fluid exits outlet 176, it has experienced a temperature drop. Such secondary fluid could then go directly to a desired chilled water application (potable or otherwise), or to a secondary heat exchanger 171 for cooling a space by having an air flow pass thereby, and such air flow could be generated by a fan, a blower, or some other source (not shown). Alternately, heat exchanger 171 could exchange heat to another fluid, such as water for potable use, industrial applications, etc., generally 177*a*. If the secondary fluid is to be used for cooling a space, then it could be water, glycol, a combination thereof, or some other suitable secondary fluid, which is preferably non-toxic, such that in the event of a leak at heat exchanger 171 or otherwise, the likelihood of such leak in a space posing a health concern would be reduced. Similarly, if potable water is to be cooled in heat exchanger 171, then the secondary fluid flowing therethrough is preferable also potable water. It is also to be understood that secondary fluid passing through chilled brazed plate 170 may be connected in parallel or in series to multiple applications where chilled water is desired, such as a potable water cooling, space cooling, water tank cooling, cooling for one or more commercial and/or industrial processes, etc. For example, the chilled secondary fluid could be used to first cool a space for so long as such cooling was required, and once that need was met, the chilled secondary fluid could then be diverted to cool potable water, pre-cool water for an ice maker, etc. Alternately, such space and application for chilled water could receive the chilled secondary fluid simultaneously, if desired.

Although chilled brazed plate 170 serves as an evaporator, it is to be understood that other types of evaporators could be used, if desired, which could include conventional fin and tube designs, micro-channel designs, falling film evaporators, etc. The speed of fan 156 may be modulated by controlling its motor, such control, in one example, being performed via controller system 400. It is to be understood, however, that such controls could also be manually performed if desired. Generally, however, fan 156 is not required to operate when system 100 is in this mode.

Upon the refrigerant exiting the discharge side 178 of chilled brazed plate 170, the refrigerant has at this point absorbed heat from the secondary fluid and has boiled, i.e., returned to its gaseous or vaporous state, and in such state, it passes via conduit system C through check valve 179 (FIGS. 1A-1E, 2, and 3) to an inlet 180*a* of a suction accumulator, generally 180. When system 100 is in a heating mode, check valve 179 prevents refrigerant gas from backflowing into chilled brazed plate 170, such backflow being undesirable in that system 100 would essentially be deprived of the use of such refrigerant coming to reside in chilled brazed plate 170. Additionally, oil in system 100 could similarly back flow into chilled brazed plate 170 which could ultimately degrade performance of chilled brazed plate 170 and/or system 100. It is noted that check valve 179 could be magnetically-operated check valve, a solenoid-operated check valve, a conventional valve (such as a ball valve) that is manually and/or automatically operated to open and close, etc.

Because compressor 124 is configured to preferably compress refrigerant in its vapor state only, suction accumulator 180 serves to reduce the likelihood of damage to and/or inefficiency of compressor 124 experiencing a sudden surge of liquid refrigerant or oil, etc., that could enter compressor 124 from its suction, or inlet side 127. Thus, should the refrigerant leaving chilled brazed plate 170 have a liquid component, suction accumulator 180 serves to prevent a surge of such liquid to compressor 124, such that the refrigerant leaving suction accumulator outlet 180*b* is substantially in a gaseous phase.

Accordingly, as shown in FIG. 1A, system 100 is configured to simultaneously produce both hot and cold secondary fluids. Hot brazed plate 140 takes advantage of the hot, high pressure gas phase of the refrigerant as it exits compressor 124, while chilled brazed plate 170 receives the refrigerant at generally a low pressure, cooled liquid state, which absorbs heat from a secondary fluid, such as water, introduced to chilled brazed plate 170. The speed of compressor 124 is in one example modulated automatically by controller system 400 and/or manually by an operator in relation to the set point proximity temperature of the hot or cold secondary fluid at hot and chilled brazed plates 140, 170, respectively. The heated secondary fluid from hot brazed plate 140 may be used as a subsequent heat exchanger 141 for heating a space or other heating needs, and/or for heating potable water available at a supply location 143, if desired. Also, a chilled secondary fluid from chilled brazed plate 170 can be used for cooling a space using heat exchanger 171, or for other cooling needs, such as for directly cooling potable water.

It should be noted that in the implementations and examples discussed herein, controller system 400 and associated circuitry (not shown) may be connected to or otherwise receive information from signals indicating the operating state of various components of system 100 during one or more modes of operation. And further, controller system 400 through such circuitry may directly control such components. Controller system 400 may be configured to control the valves referenced herein and may also be used to control operation of motor 120, compressor 124, fan 156, pumps (not shown), and the like. As will be appreciated by those skilled in the art, system 100 in one implementation includes multiple sensors, actuators, transducers, detection devices, and/or annunciators referred to collectively herein as communication interfaces 408 (FIG. 5) (not all being shown), and may be used in association with the various components of system 100, including without limitation, motor 120, compressor 124, condenser 128, 136, expansion valve 132, accumulator 180, hot and chilled brazed plates 140, 170, respectively, and refrigerant receiver 150. Further, system 100 may include instrumentation that provides information to an operator and/or controller system 400 for monitoring the instantaneous, trend, near term and long term status of operation of system 100. Further, manual overrides and other manual controls may be provided system 100 to allow an operator to modify, suspend and/or bypass controller system 400 in order to assume partial and/or total control of operation of system 100, if desired or if necessary. For example, in system 100, temperature sensors, flow rate sensors and/or pressure sensors can be used to detect the incoming temperature, pressure, flow rates of secondary fluids into and out of hot and chilled brazed plates 140 and 170, respectively. Additionally, fluid level sensors could be provided for refrigerant receiver 150 and suction accumulator 180 and at other locations of system 100, and such information can be provided to controller system 400 and/or to an instrumentation display. Refrigerant receiver 150 and suction accumulator 180 could also include temperature, pressure, and/or flow rate sensors to monitor the refrigerant passing therethrough. Similarly, compressor 124, condenser 128, expansion valve 132, evaporator 136 (to include chilled brazed plate 170), and hot brazed plate 140 can likewise include one or more sensors for detecting incoming and outgoing refrigerant temperatures, pressures, flow rates and/or state or phase of the refrigerant.

Such sensors may be used singularly or in combination, and may be used, for example, for calculation of superheat of the refrigerant upstream of compressor 124. Additionally, temperature sensors may be used to detect ambient temperature, such as of the air surrounding and circulating through a heat exchanger, for example condenser 128 and hot and chilled brazed plates 140, 170, respectively, and also for detecting the temperature of ground water and/or the temperature of ground (earth) water loops available to system 100. Such instrumentation may be connected to controller system 400 via hardwire, wirelessly, optically, sonically, and/or through other means to provide output signals and to communicate with the control circuitry of controller system 400 in a manner to allow controller system 400 to process, manipulate, scale, and make calculations and control decisions based on such signal inputs.

It is also to be understood that controller system 400 is not limited to information and/or signals received from such instrumentation, but could also draw information from and receive inputs from other sources, and such sources could be remote and received through wire or wireless connection with the Internet or communications via other means including, but not limited to, microwave, radio frequency, Bluetooth, hardwire, electricity transmission lines, telephone, and/and other available communication modalities. For example, such remote information could include current weather and/or weather forecast information obtained from the Internet which could bear on operation of system 100. In accordance with example implementations, the one or more sensors perform one or more actions in response to conditions they sense individually and or collectively, in real-time (real-time generally herein including near real-time) during operation.

FIG. 5 illustrates a control system 400 that according to some examples may be configured to at least partially implement the operation of system 100. Generally, the apparatus of exemplary implementations of the present disclosure may comprise, include or be embodied in one or more fixed, portable or embedded electronic devices. The apparatus may include one or more of each of a number of components such as, for example, a processor 402 comprising hardware and software connected to a memory 404. For each sensor, processor 402 may receive a measurement from the sensor.

The processor 402 is generally any piece or component of computer hardware that is capable of processing information such as, for example, data, computer-readable program code, instructions or the like (at times generally referred to as "computer programs," e.g., software, firmware, etc.), and/or other suitable electronic information. The processor is composed of a collection of electronic circuits some of which may be packaged as an integrated circuit or multiple interconnected integrated circuits (an integrated circuit at times more commonly referred to as a "chip"). The processor may be configured to execute computer programs, which may be stored onboard the processor or otherwise stored in the memory 404 (of the same or another apparatus).

The processor 402 may be a number of processors, a multi-processor core or some other type of processor, depending on the particular implementation. Further, the processor may be implemented using a number of heterogeneous processor systems in which a main processor is present with one or more secondary processors on a single chip. As another illustrative example, the processor may be a symmetric multi-processor system containing multiple processors of the same type. In yet another example, the processor may be embodied as or otherwise include one or more application-specific integrated circuits (ASICs), field-programmable gate arrays (FPGAs) or the like. Thus, although the processor may be capable of executing a computer program to perform one or more functions, the processor of various examples may be capable of performing one or more functions without the aid of a computer program.

The memory 404 is generally any piece or component of computer hardware that is capable of storing information such as, for example, data, computer programs (e.g., computer-readable program code 406) and/or other suitable information either on a temporary basis and/or a permanent basis. The memory may include volatile and/or non-volatile memory, and may be fixed or removable. Examples of suitable memory include random access memory (RAM), read-only memory (ROM), a hard drive, a flash memory, a thumb drive, a removable computer diskette, an optical disk, a magnetic tape or some combination of the above. Optical disks may include compact disc-read only memory (CD-ROM), compact disc-read/write (CD-R/W), digital versatile disc (DVD) or other standard media and format. In various instances, the memory may be referred to as a computer-readable storage medium which, as a non-transitory device capable of storing information, may be distinguishable from computer-readable transmission media such as electronic transitory signals capable of carrying information from one location to another. Computer-readable medium as described herein may generally refer to a computer-readable storage medium or computer-readable transmission medium.

In addition to the memory 404, the processor 402 may also be connected to one or more of the communication interfaces 408 for displaying, transmitting and/or receiving information. The communications interface may be configured to transmit and/or receive information, such as to and/or from other apparatus(es), network(s) or the like. The communications interface may be configured to transmit and/or receive information by physical (wireline) and/or wireless communications links. Examples of suitable communication interfaces include a network interface controller (NIC), wireless NIC (WNIC) or the like.

As indicated above, program code instructions may be stored in memory, and executed by a processor, to implement functions of the systems, subsystems and their respective elements described herein. As will be appreciated, any suitable program code instructions may be loaded onto a computer comprising hardware and software, or other programmable apparatus from a computer-readable storage medium to produce a particular machine, such that the particular machine becomes a means for implementing the functions specified herein. These program code instructions may also be stored in a computer-readable storage medium that can direct a computer, a processor or other programmable apparatus to function in a particular manner to thereby generate a particular machine or particular article of manufacture. The instructions stored in the computer-readable storage medium may produce an article of manufacture, where the article of manufacture becomes a means for implementing functions described herein. The program code instructions may be retrieved from a computer-readable storage medium and loaded into a computer, processor or other programmable apparatus to configure the computer, processor or other programmable apparatus to execute operations to be performed on or by the computer, processor or other programmable apparatus. Retrieval, loading and execution of the program code instructions may be performed sequentially such that one instruction is retrieved, loaded and executed at a time. In some example implementations, retrieval, loading and/or execution may be performed in parallel such that multiple instructions are retrieved, loaded, and/or executed together. Execution of the program code instructions may produce a computer-implemented process such that the instructions executed by the computer, processor or other programmable apparatus provide operations for implementing functions described herein.

Execution of instructions by a processor, or storage of instructions in a computer-readable storage medium, supports combinations of operations for performing the specified functions. In this manner, an apparatus 400 may include a processor 402 and a computer-readable storage medium or memory 404 coupled to the processor, where the processor is configured to execute computer-readable program code 406 stored in the memory. It will also be understood that one or more functions, and combinations of functions, may be implemented by special purpose hardware-based computer systems and/or processors which perform the specified functions, or combinations of special purpose hardware and program code instructions.

In FIG. 1B, one exemplary implementation of system 100 is shown in a mode (FIG. 4) configured for production of hot water. In this mode and as shown by arrows B, refrigerant passes through conduit system C from the discharge side 126 of compressor 124 through open valve SV-1B to hot brazed plate 140. The secondary fluid enters inlet 142 of brazed plate 140 and exists outlet 144, absorbing heat from hot brazed plate 140. As noted above, hot brazed plate 140 is heated by the hot pressurizes refrigerant vapor which is pressurized and which passes through hot brazed plate 140. The speed of compressor 124 is modulated automatically by controlling system 100 and/or manually based on the proximity of the output temperature of the secondary fluid from hot brazed plate 140.

The refrigerant, upon exiting hot brazed plate 140 flows via conduit system C through open valve SV-2B and on to refrigerant receiver 150, passing through subcooler 128*a* as it proceeds to refrigerant receiver 150. From refrigerant receiver 150 the relatively high pressure gas refrigerant passes via conduit system C through an open valve SV-2A (which could be connected to controller system 400 and a valve such as a solenoid valve, electric motor-controlled valve, manual valve, etc.) and an electronic expansion valve EEV B (which could be connected to controller system 400 and a valve such as an electronic valve, solenoid valve, electric motor-controlled valve, manual valve, etc.) through condenser 128, becoming a low pressure gas and passes through condenser 128 and absorbs heat from the ambient air, with fan 16 being modulated by controller system 400 and/or manually depending on the ambient temperature. Thus, in this mode, condenser 128 acts as an evaporator, wherein the refrigerant absorbs heat and gains pressure as a gas. From condenser 128, the substantially low pressure gas refrigerant flows via conduit system through open valve SV-4 (which could be connected to controller system 400 and a valve such as a solenoid valve, electric motor-controlled valve, manual valve, etc.) and then, via conduit system C, through suction accumulator 180 and to the inlet side 127 of compressor 124, where the refrigerant's cycle may then be repeated. In the event neither an ambient air nor a groundwater/ground loop source provides adequate heat for extraction by system 100 to meet desired temperatures and/or demand for heated secondary fluid, system 100 can also be provided with other heat sources, such as a boiler, furnace, heat exchanger (none shown), which could be used to preheat the secondary fluid prior to entering system 100 and/or for supplementing heating of such secondary fluid upon its exiting system 100.

FIG. 1C illustrates one example implementation of system 100 in a substantially chilled secondary fluid-producing mode (FIG. 4). In this example as shown by arrows 1C, high pressure refrigerant gas from the outlet 126 of compressor 124 passes through open valve SV-1A (which could be connected to controller system 400 and a valve such as a solenoid valve, electric motor-controlled valve, manual valve, etc.) and then through condenser 128 and refrigerant receiver 150, which may act as a reservoir for storing refrigerant not instantaneously required by system 100. The speed of compressor 124 is modulated by controller system 400 and/or manually dependent on the temperature of the secondary fluid exiting chilled brazed plate 170. The provision of such a reservoir of refrigerant allows additional refrigerant to be selectively introduced into system 100 as needed, which may be determined by controller system 400 and/or by an operator using one or more manual controls. Refrigerant reservoir 150 also allows for refrigerant to be selectively removed from system 100 to prevent or reduce the likelihood of over-pressurization of system 100 due to an excess amount of refrigerant being in one or more locations of system 100. The speed of fan 156 may be modulated dependent on the desired pressure of refrigerant in condenser 128 and/or the ambient temperature by controlling the motor of fan 156, such control, in one example, being performable via controller system 400. It is to be understood, however, that such controls could also be manually performed if desired.

From condenser 128 and refrigerant receiver 150, the refrigerant, now substantially in liquid form, passes through an open valve SV-3 (which could be connected to controller system 400 and a valve such as a solenoid valve, electric motor-controlled valve, manual valve, etc.) and expansion valve 132 which in one implementation is, as noted above, electrically-operated and may be controlled by controller system 400. The refrigerant in a cooled low pressure gas state flows from expansion valve 132 to the inlet 172 of chilled brazed plate 170, and the secondary fluid, such as water, enters inlet 174 of chilled brazed plate 170, wherein the refrigerant absorbs heat from such water, thereby cooling such secondary fluid. The cooled secondary fluid then flows from chilled brazed plate 170 via outlet 176. As discussed above with respect to the example of FIG. 1A, this chilled secondary fluid can then be sent to heat exchanger 171 for use in cooling a space and/or may be used to cool potable water or water used for other purposes such as industrial and/or commercial uses. After passing through chilled brazed plate 170, the refrigerant, now in a substantially vapor state after absorbing heat from the secondary fluid flowing through chilled brazed plate 170, passes through via conduit system C through suction accumulator 180 and then to the inlet 127 of compressor 124.

FIG. 1D illustrates an example implementation of system 100 in a substantially defrost mode (FIG. 4). In this mode, and as shown by arrows D, high pressure gaseous refrigerant exits compressor 124 outlet 126 and passes through open valve SV-1A via conduit system C and then passes to condenser 128. The speed of compressor 124 is modulated automatically by controller system 400 and/or manually dependent on the calculated necessary defrost intervals, as determined by controller system 400 and/or by preset intervals. Fan 156 is typically not active during this mode of system 100. The refrigerant passes through condenser 128 and refrigerant receiver 150 via conduit system C and then passes through open valve SV-3. After passing through open valve SV-3, the refrigerant, now in a generally liquid phase, passes through an expansion valve 132, namely, expansion valve EEV A (which could be connected to controller system 400 and a valve such as an electronic valve, a solenoid valve, electric motor-controlled valve, manual valve, etc.), and then on through chilled brazed plate 170. After passing through chilled brazed plate 170, the gaseous refrigerant passes on through suction accumulator 180 and then on to the inlet 188 of compressor 124 such that the cycle may again be repeated.

FIG. 1E illustrates an example system 100 configured in a mode for use of ground water and/or one or more earth (ground) loops. Each of the modes discussed above in relation to FIGS. 1A-1D could be accomplished with the configuration of system 100 shown in FIG. 1E. Such ground water can be supplied to system 100 via a well or through a loop of pipe of conduit buried in the ground, ocean, a body of water, or other substance. The loop of pipe or conduit picks up heat from the earth, body of water, etc. or discharges heat thereto, as the case may be, depending on the operation mode of system 100. For example, in the event the inputs from system 100's sensors discussed herein, including from ambient air temperature sensors, provided to controller system 400 and/or an operator, indicate it is more beneficial to take heat from ground water or such loop, instead of to or from the air, then when system 100 is in automatic mode, controller system 400 directs the system 100, and in particular, the valving thereof, to assume a configuration for using ground water for discharging heat thereto via the ground water and/or loop, or obtaining heat from the ground water and/or loop.

If controller system 100 determines that under the then-current operating conditions of system 100 that the coefficient of performance of system 100 would be enhanced by discharging heat to groundwater and/or such loop as compared to discharging such heat to the air, then ground water and/or water or a secondary fluid form such loop is introduced through valve 142*a* into inlet 142 of hot brazed plate 140 and discharged via valve 144*a* to the ground water and/or loop, or perhaps to grade or the ground's surface via outlet 144 of hot brazed plate 140.

If controller system 100 determines that under the then-current operating conditions of system 100 that the coefficient of performance of system 100 would be enhanced by absorbing heat from groundwater and/or such loop as compared to absorbing such heat from the air, then ground water and/or water or a secondary fluid form such loop is introduced through valve 174*a* into inlet 174 of chilled brazed plate 170 and discharged via valve 176*a* to the ground water and/or loop, or perhaps to grade or the ground's surface via outlet 176 of hot chilled plate 170.

It is to be understood that if such ground water is drawn from a well, then the water exiting hot brazed plate 140 or chilled brazed plate 170 could flow to an auxiliary heat exchanger, such as auxiliary heat exchangers 141 or 171 (not shown in FIG. 1E) discussed above, for providing heated or chilled water, respectively, either for cooling of air within a space, water, or some other fluid, as desired. Additionally, a separate open loop could be used in this configuration, as also in the configurations above, to take advantage of the heating and cooling provided by such heat exchangers to heat or cool potable water or some other fluid in an open loop arrangement. Alternately, or in addition, an open loop could be provided for communicating with such auxiliary heat exchanger to provide heated potable water or other fluid. As shown in FIG. 1E, when ground water and/or loop secondary fluid/water is used, the refrigerant passing from compressor 124 passes through valve SV-1B and, via conduit hot brazed plate 140. Such refrigerant also passes through refrigerant receiver 150, but generally bypasses altogether condenser 128, and fan 156 would, consequently, typically be operational and the speed of fan 156 modulated dependent on the desired temperature and/or pressure of refrigerant in condenser 128 via controller system 400. The refrigerant then flows through SV-3 and through expansion valve 132 and on through chilled brazed plate 170, and then on through suction accumulator 180 and back and out in a gaseous phase, through the inlet 188 of compressor 124.

FIG. 2 illustrates a more detailed view of condenser 128. Condenser 128 includes a plurality of outlet conduits which flows from a manifold, generally 190, as the refrigerant is delivered from expansion valve EEV B, such as in the case when system 100 is in the hot water producing mode as shown in FIG. 1B and discussed above. Note that prior to entering manifold 190, the refrigerant it passes via conduit system C through check valve 189. When system 100 is in a heating mode, check valve 189 prevents refrigerant gas from flowing through subcooler 128*a* and assists in maintaining flow of the refrigerant through condenser 128. It is noted that check valve 189 could be magnetically-operated check valve, a solenoid-operated check valve, a conventional valve (such as a ball valve) that is manually and/or automatically operated to open and close, etc.

In this manner, the refrigerant, after passing through expansion EEV B absorbs heat in condenser 128 and returns to a substantially gaseous phase prior to entering suction accumulator 180 and in turn inlet 188 of compressor 124. As shown in FIG. 2, input 192 is connected to expansion valve EEV B. Input 194 is connected to valve SV-1A, and outlet 196 is connected to valve SV-4. Inlet 198 is connected to valve SV-2B downstream of the outlet of hot brazed plate 140, and outlet 200 is connected to the inlet 202 of refrigerant receiver 150, which also includes an outlet 204.

FIG. 3 illustrates schematically an example of system 100 having sensors, and more specifically, thermistors 220, 222, and 224 and pressure transducers 230 and 232. Thermistor 220 is associated with sensing the refrigerant of inlet temperature of the suction accumulator 180, and thermistor 222 is associated with sensing the discharge temperature of refrigerant from compressor 124. Thermistor 224 is associated with sensing the temperature of the outlet of refrigerant receiver 150. It is to be understood that thermistors 220, 222, and 224 may be connected through circuitry discussed above to controller system 400.

Pressure transducer 230 is associated with the inlet pressure of the refrigerant at the suction accumulator 180, and pressure transducer 232 is associated with the pressure of the refrigerant in a conduit on the discharge side of compressor 124. Sight glasses 240 and 242 may be provided for observance by an operator in the conduit leading to the inlet of the cold water brazed plate 170. As with thermistors 220, 222, and 224, transducers 230 and 232 may be in operable communication with controller system 400 and the circuitry related thereto in order for the controller system 400 to direct operation of system 100.

FIG. 4 illustrates a table including various methods and modes of operations of system 100 discussed above and the associated operational parameters for each mode, namely the simultaneous heating and cooling (SHC) mode (see FIG. 1A), the heat only mode (see FIG. 1B), the cool only mode (see FIG. 1C), and the defrost mode (see FIG. 1D). As shown, the methods and modes may include a number of operations performed continuously in real-time during operation of system 100. More specifically, FIG. 4 lists each mode of operation of system 100, and for each such mode, the status of operation of outdoor condenser 128 and outdoor fan 156, the modulation protocol of compressor 124, the status of the solenoid valves SV-1A, SV-1B, SV-2A, SV-2B, SV-3, and SV-4, the status of the expansion valves EEV A and EEV B, and the status of use of groundwater/ground loop sources.

In an example implementation of system 100, the sensors, to include the thermistors 220, 222, and 224, transducers 230 and 232, through their connection with controller system 400 allows system 100 to selectively use air or ground water/loop water (or secondary fluid) to heat water and to cool water. Due to the valving arrangements and the interconnections of conduit system C and components of system 100, reversing valves may not be required, since system 100 is configured such that refrigerant generally flows through any given conduit in use in a particular mode of operation in one direction only. This not only allows for the elimination of reversing valves, it also allows motor 120 to always rotate in the same direction, if desired. In one example implementation, motor 120 is a direct current (DC) variable speed motor and is inverter controlled, allowing it to use alternating current (AC) for its operation. Compressor 124 in an example implementation is a scroll-type compressor and can include in one implementation a scroll compressor manufactured by Copeland, Model No. ZPV0382E-2E9-XXX. Although, it is to be understood that other compressors and compressor styles, including without limitation rotary compressors, could also be used if desired.

In the example system 100, the configuration thereof discussed above (which could, of course, be modified as necessary by one of ordinary skill in the art) includes the ability, through working via controller system 400 to selectively change its mode of operation between: simultaneously heating and cooling of water; dedicated hot water production; dedicated cold water production; defrosting; and the use of ground water/ground loop secondary fluid (which may include water) in a non-disruptive manner, i.e., motor 110 may continue to run, driving compressor 124, and the valves of system 100 do not require reversing nor is the direction of refrigerant required to reverse through a particular conduit.

The amount of refrigeration in circulation in system 100 may vary at any given time, depending on the mode of operation, demand, heat source and heat sink conditions, etc. and the speed of compressor 124. An example of system 100 as disclosed herein also allows controller system 400, based on the sensor information delivered thereto, the ability to add and remove selected amounts of refrigerant from the system, such as via selective use of refrigerant receiver 150 in order to prevent system 100 from being starved of needed refrigerant, and from system 100 being over-pressurized by an excess of refrigerant. Such configuration also allows for refrigerant to be accumulated and held as needed generally on an instantaneous basis during operation of system 100 through its various modes of operation discussed above.

In an example implementation of system 100, the refrigerant is managed through operation, under the direction of controller 400, of the valves, fans, pumps (not shown), etc. discussed herein. Refrigerant management facilitates adequate refrigerant in each operational heat exchanger, to include hot brazed plate 140, chilled brazed plate 170, condenser 128, subcooler 128*a*, and auxiliary heat exchangers 141, 171, etc., while at the same time preventing excessive accumulation of refrigerant in any location. One or more liquid refrigerant receivers 150 and accumulators 180 may be provided in order to optimize the amount of refrigerant in circulation at any given time during operational modes. Instead of, or in addition to use of a ground loop, a dry tower, or wet cooling tower could also be used. It is to be understood that as system 100 transitions between modes of operation, the speed of compressor 124 may be modulated by controller system 400 to lessen the likelihood of thermal effects and/or pressure change/surge effects which may occur in refrigerant liquids and gases upon sudden momentum changes, e.g. fluid hammer effects, within conduit system C and other components of system 100, particularly when valves in system 100 close. System 100 may also be configured to initiate a pump down cycle in order to retrieve refrigerant that may remain in system 100, e.g., refrigerant that may remain in the chilled brazed plate 170, upon switching of modes of operation and to transfer such refrigerant to the liquid receiver 150 and/or the suction accumulator 180 for future selective use by system 100. Generally, such a pump down cycle is not required when system 100 is in its simultaneous heating and cooling mode.

Example

In one example implementation of a heat source optimization system according to the present disclosure, which example should not be interpreted as placing limitations on other implementations of such disclosure, performance testing of such system yielded results substantially as shown below. Such performance testing was conducted in accordance with ANSI/AHRI Standard 550/590-2011 (I-P) With Addendum 1: "Performance Rating of Water-Chilling and Heat Pump Water Heating Packages using the Vapor Compression Cycle" published by The Air-Conditioning, Heating, and Refrigeration Institute, which is incorporated herein by reference.

| Unit Nameplate | | Compressor | |
|---|---|---|---|
| Manufacturer: MultiAqua | | Manufacturer: Copeland Scroll | |
| Model No.: MHRC-60-01 | | Model No.: ZPV0382E-2E9-XXX | |
| Serial No.: MHRC-60-410-G31-14-002 | | Serial: 14E1A018L | |
| Voltage: 230 | Amps: 30 | Voltage: 230 | Amps: 25.5 |
| Hertz: 60 | Phase: 1 | Hertz: 60 | Phase: 1 |
| Refrigerant: R-410a | Charge: 19.5 LBS/Circuit | | |

COOLING PERFORMANCE TESTS

| Test: | 100% | 75% | 50% | 25% |
|---|---|---|---|---|
| Indoor Inlet DB ° F. | 95.00 | 79.97 | 64.87 | 55.02 |
| Indoor Inlet WB ° F. | 79.20 | 68.08 | 56.70 | 48.34 |
| Inlet Water ° F. | 51.27 | 52.01 | 52.27 | 52.31 |
| Outlet Water ° F. | 43.91 | 44.06 | 44.09 | 44.00 |
| Water Delta T ° F. | 7.36 | 7.95 | 8.18 | 8.31 |
| Flow Rate GPM | 12.06 | 12.06 | 12.08 | 12.04 |
| Total Flow Gal | 205,754 | 207,210 | 209,250 | 211,385 |
| Water Pressure Drop | 6.04 | 6.07 | 6.10 | 6.13 |
| Barometer in-hg | 28.66 | 28.63 | 28.61 | 28.59 |
| Capacity Btu/h | 44,457.4 | 48,042.0 | 49,494.2 | 50,100.5 |
| Corrected Capacity Btu/h | 44,699.6 | 48,309.9 | 49,776.4 | 50,389.0 |
| Inlet Relative Humidity % | 50.86 | 55.35 | 61.37 | 62.51 |
| Voltage V | 229.6 | 229.70 | 230.80 | 229.89 |
| Current A | 19.66 | 16.82 | 17.19 | 15.40 |
| Total Power watts | 4,402.40 | 3,771.70 | 3,177.84 | 2,843.53 |
| Compressor Discharge PSIG | 367.88 | 297.94 | 237.22 | 203.01 |
| Compressor Suction PSIG | 111.79 | 107.58 | 100.55 | 96.77 |
| Discharge Temp ° F. | 116.65 | 101.57 | 85.96 | 76.16 |
| Liquid Temp ° F. | 102.40 | 86.17 | 70.01 | 59.89 |
| Suction Temp ° F. | 56.32 | 55.94 | 53.64 | 52.53 |
| Energy Efficiency Ratio, | 10.098 | 12.737 | 15.575 | 17.619 |
| Corrected EER | 10.224 | 12.889 | 15.778 | 17.851 |
| Calculated IPLV | | 14.75784 | | |

HEATING PERFORMANCE TESTS

| | Heating | | Low Temp | |
|---|---|---|---|---|
| Test: DB/WB/Outlet Water Temp | 47/43/10 | 47/43/120 | 17/15/105 | 17/15/120 |
| Indoor Inlet DB ° F. | 46.9 | 47.03 | 17.03 | 16.94 |
| Indoor Inlet WB ° F. | 42.9 | 42.98 | 15.02 | 14.99 |

-continued

| HEATING PERFORMANCE TESTS | | | | |
|---|---|---|---|---|
| | Heating | | Low Temp | |
| Test: DB/WB/Outlet Water Temp | 47/43/10 | 47/43/120 | 17/15/105 | 17/15/120 |
| Outlet Water Hot ° F. | 105.0 | 119.56 | 104.52 | 120.78 |
| Inlet Water Hot ° F. | 95.5 | 108.85 | 97.89 | 114.12 |
| Water Delta T ° F. | 9.4 | 10.71 | 6.63 | 6.66 |
| Flow Rate GPM | 12.1 | 11.45 | 11.93 | 12.15 |
| Total Flow Gal | 21828 | 219886 | 230988 | 232712 |
| Water Pressure Drop in-hg | 32.681 | 34.14 | −3.22 | −3.2397 |
| Barometer in-hg | 28.5 | 28.6 | 28.69 | 28.72 |
| Capacity Btu/h | 57591. | 61407.4 | 39610.4 | 40480.8 |
| Inlet Relative Humidity % | 73.2 | 73 | 67.72 | 68.5 |
| Voltage V | 230. | 231.14 | 231.6 | 230.8 |
| Current A | 26. | 31.11 | 24.44 | 28.22 |
| Total Power watts | 5916.2 | 6971 | 5487.84 | 6302.7 |
| Compressor Discharge PSIG | 353.7 | 437.17 | 343.66 | 431.35 |
| Compressor Suction PSIG | 65.6 | 73.36 | 40.7 | 42.96 |
| Discharge Temp ° F. | 93.6 | 83.26 | 71.12 | 82.86 |
| Liquid Temp ° F. | 87.4 | 98.21 | 81.19 | 95.38 |
| Suction Temp ° F. | 36.3 | 37.2 | 11.2 | 11.27 |
| COPH | 3.09 | 2.804 | 2.298 | 2.045 |

| WATER TO WATER PERFORMANCE TESTS | | |
|---|---|---|
| Test: Outlet Cold/Outlet Hot | 44/105 | 44/120 |
| Outlet Water Hot ° F. | 104.89 | 119.95 |
| Inlet Water Hot ° F. | 97.43 | 112.59 |
| Water Delta T ° F. | 7.46 | 7.36 |
| Inlet Water Cold ° F. | 51.8 | 51.03 |
| Outlet Water Cold ° F. | 44.49 | 44.32 |
| Flow Rate GPM | 15.09 | 15.17 |
| Total Flow Gal | 237443 | 240261 |
| Water Pressure Drop in-hg | 4.58 | 4.59 |
| Barometer in-hg | 28.76 | 28.75 |
| Capacity - Hot Side | 56,396.1 | 55,907.7 |
| Capacity - Cold Side | 44,087.1 | 40,354.5 |
| Inlet Relative Humidity % | 100.23 | 100.34 |
| Voltage V | 232.65 | 233.85 |
| Current A | 16.22 | 19.08 |
| Total Power watts | 3714.8 | 4383.1 |
| Compressor Discharge PSIG | 351.24 | 426.24 |
| Compressor Suction PSIG | 109.06 | 113.12 |
| Discharge Temp ° F. | 107.85 | 122 |
| Liquid Temp ° F. | 99.1 | 113.94 |
| Suction Temp ° F. | 56.15 | 56.71 |
| COPHR | 7.93 | 6.44 |

FIG. 6 illustrates an alternate implementation of a heat source optimization system, generally 100*a*, according to one or more examples of the present disclosure, and although in FIG. 6 like reference numerals correspond to similar, though not necessarily identical, components and/or features as disclosed and described above, for the sake of brevity, reference numerals or features having a previously described function may not necessarily be described in connection with FIG. 6 and/or other drawings in which such components and/or features appear.

System 100*a*, or at least a portion thereof, is carried within a housing, generally 300, and such housing 300 could be constructed of metal, plastic, or some other suitable material. In one implementation, housing 300 is constructed of sheet metal and is fabricated such that it provides a relatively weather-tight enclosure for system 100*a*. As shown in FIG. 6, system 100*a* includes at least one motor 120, compressor 124, condenser 128, and expansion valve 132, and evaporator, generally 136, (which includes chilled plate heat exchanger 170), and a hot brazed plate 140 (with refrigerant inlet 140 and outlet 140*b*) in a loop, such components being connected in a loop that allows refrigerant to repeatedly cycle through system 100*a*.

System 100*a* also includes control configuration as does system 100 above. Essentially, system 100*a* is very similar to system 100 and the operational modes of system 100 discussed above, but further includes a check valve 146 in line C between the outlet 140*b* of hot brazed plate 140 and valve SV-2B, for selectively preventing flow of refrigerant in a direction from valve SV-2B back towards hot brazed plate 140. Also illustrated in FIG. 6 with regard to system 100*a* is an additional representation of a reservoir, or storage tank, generally CT, for chilled water or other fluid, such as glycol-based fluid. Alternately, thermal storage battery materials could be used in tank CT, including without limitation, a fluid of approximately 25% propylene glycol, and could take the form of fluid-containing plastic balls know as Ice Balls™, sold by Cryogel of San Diego, California, USA (www.cryogel.com), such balls 360 may be placed in tank CT and depending on the mode in which system 100*a* is operating, may be cooled and/or frozen by means of circulating water and/or a glycol-based fluid from chilled plate heat exchanger 170 around the balls 360. When it is desired to obtain cooling from such balls, i.e., when the balls are in a discharge mode, the same water and/or glycol-based solution can be circulated through the balls 360 in tank CT, thereby removing heat from, and thus cooling, such water or glycol-based solution prior to proceeding to chilled plate heat exchanger 170. Water is pumped from tank CT through a conduit C via a cold water pump 302. Interposed between chilled plate heat exchanger 170 in conduit C in fluid communication with cold tank CT is a valve 304, which could be an automatic valve controlled by control configuration 400 and/or manually operable. Water or other fluid flowing through valve 304 is then subjected to a strainer 305 prior to pump 302. Pump 302 then pumps the fluid to the inlet 174 of chilled plate heat exchanger, or chilled brazed plate, 170. The outlet 176 of chilled plate heat exchanger delivers chilled water or other fluid via conduit C back to tank CT, and an automatic or manually operable valve 306 controls flow of such fluid into tank CT. Also in conduit C between chilled plate heat exchanger 170 and valve 306 is a temperature sensor 308 for sensing the temperature of the fluid and a flow switch 310 for monitoring the rate of flow of fluid back to tank CT. Flow switch 310 and temperature sensor 308 are in one implementation interconnected and operated by control configuration 400.

Also found in system 100*a* is a storage tank, generally HT, for storing heated water or other heated fluid such as a glycol-based fluid. Fluid is drawn into conduit C from tank HT through valve 312, which could be an automatic valve in communication with control configuration 400 and/or a manually operated valve. The fluid then flows through strainer 314 and into pump 316, and then proceeds to inlet 142 into a heat exchanger, namely hot brazed plate 140. The heated fluid exits the heat exchanger through outlet 144 and proceeds through conduit C and through valve 318 (which could be an automatic valve control by control configuration 400 and/or a manually operated valve). After passing through valve 318, the heated fluid returns to tank HT. Provided in conduit C between the heat exchanger and tank HT is a fluid temperature sensor 320 and a fluid flow sensor 322 for sensing the temperature and flow rate, respectively, of fluid heated by the heat exchanger.

As discussed above regarding tank CT, alternately, thermal storage battery materials could also be used in tank HT, including without limitation, a fluid of approximately 25% propylene glycol, and could take the form of Ice Balls™ 360, sold by Cryogel of San Diego, California, USA (www.cryogel.com) and could be used as similarly discussed above, wherein, depending on the mode in which system 100*a* is operating, during a charge mode, water and/or a glycol-based fluid is circulated through the balls 360 in tank HT, where such fluid would transfer heat to such balls 360 for storing such heat in the balls 360. During the discharge mode of such heated balls 360, the same fluid could be circulated through the 360 balls 360 in tank HT, wherein the balls 360 would discharge their heat to such fluid, i.e., thereby heating such fluid as it circulates in tank HT and prior to such heated fluid exiting such tank HT via valve 312 and proceeding on to hot brazed plate 140.

System 100*a* may also include a refrigerant temperature sensor 324 and a refrigerant pressure sensor 326 in conduit C downstream of compressor 124. Sensors 324 and 326 could be connected to and controlled by control configuration 400 and serve to detect, respectively, the temperature and pressure of refrigerant exiting compressor 124. A coil temperature sensor 328 is provided in conduit C between condenser 128 and receiver 150 for sensing the refrigerant temperature, and such sensor 328 can be connected to control configuration 400. A sensor 330 is provided in conduit C between receiver 150 and valve SV-2A for detecting the refrigerant flow from receiver 150 via outlet 204.

A suction pressure sensor 332 is provided in conduit C between chilled brazed plate 170 and suction accumulator 180 and detects the pressure of the refrigerant prior to entering suction accumulator 180. A suction temperature sensor 334 is provided in conduit C between suction accumulator 180 and compressor 124 and detects the temperature of the refrigerant as it leaves suction accumulator 180 and enters compressor 124.

System 100*a* may also include within housing 300 an onboard inverter, generally 340, for converting DC voltage into alternating current (AC) voltage for use by system 100*a*. Inverter 340 could also be the source of a standalone AC power supply, which could provide auxiliary power to other devices and/or systems (none shown) in addition to providing power to system 100*a*. Inverter 340 could be a PIKA inverter such as sold by PIKA Energy, LLC of Gorham, Maine, USA.

Inverter 340 could receive DC voltage input from a variety of DC voltage sources, including solar panels 350, batteries 352, fuel cells 354, wind power 356, or a combination of the foregoing.

In the event DC voltage from one or more of such sources is provided to system 100*a*, a voltage modulator (not shown) may need to be used in order to provide pulse to DC power for driving motor 120, which in turn powers compressor 124. Control configuration 400, however, could be configured to run directly on DC power from such DC voltage sources.

The operation of systems 100 and/or 100*a* can be configured such that one or more check valves 146, 179, and 189 are opened for a period of time in order to release refrigerant ordinarily held back by such check valve, in order for such refrigerant to be put back in circulation within the respective system 100 or 100*a*. The opening of one or more of the check valves in this manner should not appreciably affect overall efficiency of the system and helps accommodate a phenomenon which may occur, wherein check valves do not fully seat, meaning the longer such check valve sits idle, the more refrigerant leaks by it. Therefore, the controlled release of refrigerant by selectively opening one or more of the check valve tends to prolong the operable life of the check valves.

FIGS. 7-9 illustrates a schematic diagram of another alternate implementation of a heat source optimization system, generally 100*b*, according to one or more examples of the present disclosure, and more specifically: FIG. 7 illustrates system 110*b* in a cooling mode; FIG. 8 illustrates system 100*b* in a heating mode; and FIG. 9 illustrates system 100*b* in a simultaneous heating and cooling mode. Although in FIGS. 7-9 like reference numerals correspond to similar, though not necessarily identical, components and/or features as disclosed and described above, for the sake of brevity, reference numerals or features having a previously described function may not necessarily be described in connection with FIGS. 6-9 and/or other drawings in which such components and/or features appear.

As shown in FIG. 7, system 100*b*, or at least a portion thereof, is carried within housing 300, includes at least one motor 120, compressor 124, condenser 128, expansion valve 132, evaporator 136 (which includes chilled plate heat exchanger 170), and a hot brazed plate 140 (with refrigerant inlet 140*a* and outlet 140*b*), such components being connected in a refrigerant loop that allows refrigerant to repeatedly cycle through system 100*b*.

Depending on the operational mode of system 100*b*, i.e., cooling (FIG. 7), heating (FIG. 8), or simultaneous heating and cooling (FIG. 9), the flow of refrigerant through system 100*b* may vary. For example, in the cooling mode, the flow of refrigerant is illustrated in FIG. 7 by arrowheads AHC. In the heating mode, the flow of refrigerant is illustrated in FIG. 8 by arrowheads AHH, and in the simultaneous heating and cooling mode, the flow of refrigerant is illustrated in FIG. 9 by arrowheads AHS.

System 100*b* also includes control configuration as do systems 100 and 100*b* above. Essentially, system 100*b* is similar to systems 100 and 100*b* and the operational modes of such systems 100*b* and 100*b* discussed above. As compared to system 100*b*, system 100*b* further includes a valve 500, which could be a solenoid-operated valve, in line 502. Line 502 connects lined 504 (which connects condenser 128 and receiver 150) and line 506 (which connects manifold 190 and hot brazed plate 140). When system 100*b* is in the heating mode (FIG. 8), valve 500 may be actuated in order to keep refrigerant from passing into the subcooler portion of condenser 128, thereby increasing the overall operating efficiency of system 100*b*.

System 100*b* also includes a check valve 510 in a line 512. Line 512, which in one implementation could be a capillary tube, connects line 506 with line 514 (which connects chilled plate heat exchanger 170 and suction accumulator 180). Interposed in line 512 between line 506 and check valve 510 is a filter dryer 516. In the event refrigerant manages to pass through check valve 510, such refrigerant is transferred back into line 514 of the refrigerant loop via line 512.

Also illustrated in FIG. 7 is storage tank CT, for chilled water or other fluid, such as glycol-based fluid. Alternately, thermal storage battery materials could, as discussed above in regard to system 100*b* shown in FIG. 6, be used in tank CT, including without limitation, a fluid of approximately 25% propylene glycol, and could take the form of fluid-containing plastic balls 360, which may be placed in tank CT and, depending on the mode in which system 100*b*, is operating, may be cooled and/or frozen by means of circulating water and/or a glycol-based fluid from chilled plate heat exchanger 170 around the balls 360.

Also found in system 100*b*, as in system 100*b* discussed above, includes storage tank HT for storing heated water or other heated fluid such as a glycol-based fluid. Fluid is drawn into conduit C from tank HT through valve 312, which could be an automatic valve in communication with control configuration 400 and/or a manually operated valve. As discussed above regarding tank CT, alternately, thermal storage battery materials could also be used in tank HT, including without limitation, a fluid of approximately 25% propylene glycol, and could take the form of balls 360 wherein, depending on the mode in which system 100*b* is operating, during a charge mode, water and/or a glycol-based fluid is circulated through the balls 360 in tank HT, where such fluid would transfer heat to such balls 360 for storing such heat in the balls 360. During the discharge mode of such heated balls 360, the same fluid could be circulated through the 360 balls 360 in tank HT, wherein the balls 360 would discharge their heat to such fluid, i.e., thereby heating such fluid as it circulates in tank HT and prior to such heated fluid exiting such tank HT via valve 312 and proceeding on to hot brazed plate 140.

System 100*b* may also include a refrigerant temperature sensor 324 and a refrigerant pressure sensor 326 in conduit C downstream of compressor 124. Sensors 324 and 326 could be connected to and controlled by control configuration 400 and serve to detect, respectively, the temperature and pressure of refrigerant exiting compressor 124. A coil temperature sensor 328 is provided in conduit C between condenser 128 and receiver 150 for sensing the refrigerant temperature, and such sensor 328 can be connected to control configuration 400. A sensor 330 is provided in conduit C between receiver 150 and valve SV-2A for detecting the refrigerant flow from receiver 150 via outlet 204.

A suction pressure sensor 332 is provided in conduit C between chilled brazed plate 170 and suction accumulator 180 and detects the pressure of the refrigerant prior to entering suction accumulator 180. A suction temperature sensor 334 is provided in conduit C between suction accumulator 180 and compressor 124 and detects the temperature of the refrigerant as it leaves suction accumulator 180 and enters compressor 124.

System 100*b* may also include within or outside of housing 300, the onboard inverter 340 for converting DC voltage into alternating current (AC) voltage for use by system 100*b*. Inverter 340 could also be the source of a standalone AC power supply, which could provide auxiliary power to other devices and/or systems (none shown) in addition to providing power to system 100*b*. As discussed with system 100*a*, inverter 340 could receive DC voltage input from a variety of DC voltage sources, including solar panels 350, batteries 352, fuel cells 354, wind power 356, or a combination of the foregoing.

In the event DC voltage from one or more of such sources is provided to system 100*b*, a voltage modulator (not shown) may need to be used in order to provide pulsed DC power for driving motor 120, which in turn powers compressor 124. Control configuration 400, however, could be configured to run directly on DC power from such DC voltage sources.

The operation of system 100*b*, as discussed above regarding systems 100 and 100*a*, can be configured such that one or more check valves 146, 179, and 189 are opened for a period of time in order to release refrigerant ordinarily held back by such check valve, in order for such refrigerant to be put back in circulation within the respective system 100 or 100*b*.

As shown in FIGS. 10-15, one exemplary implementation of the present invention includes a system provided for controlling the water distribution, generally 600, in systems used in a heating, ventilation, air conditioning, refrigeration, fluid heating and/or chilling configuration for heating and/or cooling a space and/or a fluid, including in connection with the heat recovery systems 100, 100*a*, and 100*b* discussed above.

The system 600 includes, as shown in detail in FIGS. 14 and 15, a cold water supply 602 adapted to supply cold water to one or more fan coil units or chilled beam units, after which such cold water is returned to a chiller, such as a heat recovery chiller 606, thereby forming a cold water loop. A hot water supply 604 adapted to supply hot water to one or more fan coil units or chilled beam units, after which such hot water is returned to a chiller, such as the heat recovery chiller 606, thereby forming a hot water loop. Note that a heat recovery system, including without limitation heat recovery systems 100, 100*a*, 100*b*, or 606 (FIGS. 14 and 15), could serve as both the cold water supply 602 and the hot water supply 604, if desired discussed above. A first fan coil, generally 608*a*, or chilled beam device, generally 610*a*, a second fan coil 608*b* or chilled beam device 610*b*, such as an active chilled beam device, a third fan coil 608*c* or chilled beam device 610*c*, and a fourth fan coil 608*d* or chilled beam device 610*d* are provided as is a cold water supply line 612 in fluid communication with the cold water supply 602 and a hot water supply line 613 in fluid communication with the hot water supply 606.

A first control valve device 614*a*, a second control valve device 614*b*, a third control valve device 614*c*, and a fourth control valve device 614*d* are provided, and each are, in one exemplary implementation, a six-way electric, servomotor-operated operated valve, such as sold by Belimo Aircontrols (USA), Inc., although other suitable valves could also be used.

Each of the valve devices 614*a*, 614*b*, 614*c*, and 614*d* includes: (a) a cold water inlet 616 in fluid communication with and configured to receive cold water from the cold water supply line 612; (b) a cold water outlet 618 in fluid communication with and configured to supply cold water to the cold water supply line 612; (c) a cold water output in fluid communication with and configured to supply cold water from the cold water supply line 612 to at least one of the fan coils 608*a*, 608*b*, 608*c*, and 608*d* or chilled beam devices 610*a*, 610*b*, 610*c*, and 610*d*; (d) a cold water return inlet 622 in fluid communication with a configured to receive from the fan coils 608*a*, 608*b*, 608*c*, and 608*d* or chilled beam devices 610*a*, 610*b*, 610*c*, and 610*d*, the cold water supplied by the cold water output and outputting the cold water to the cold water supply line 612 via the cold water outlet 618; (e) a hot water inlet 624 in fluid communication with the hot water supply line 613; (f) a hot water return outlet 625 in fluid communication with the hot water supply line 613; (g) a hot water output 626 in fluid communication with and configured to supply hot water from the hot water supply 604 to at least one of the fan coils 608*a*, 608*b*, 608*c*, and 608*d* or chilled beam devices 610*a*, 610*b*, 610*c*, and 610*d*; and (h) a hot water return inlet 628 in fluid communication with and configured to receive from at least one of the fan coils 608*a*, 608*b*, 608*c*, and 608*d* or chilled beam devices 610*a*, 610*b*, 610*c*, and 610*d*, the hot water supplied by the hot water output 626 and outputting such hot water to the hot water supply line 613 via the hot water outlet return inlet 628.

A first cold water tee 630 and the cold water supply line 612 has a first cold water outlet connected to the cold water return inlet 622 of the first control valve device 614*a*, and a second control water outlet is connected to the cold water inlet 616 of the second control valve device 614*b*.

A first hot water tee 636 in the hot water supply line 613 has a first hot water outlet connected to the hot water inlet 624 of the first control valve device 614*a*, and a second hot water outlet is connected to the hot water inlet 624 of the second control valve device 614*b*.

A second cold water tee 642 in the cold water supply line is downstream of the first cold water tee 630 and has a first cold water outlet connected to the cold water inlet of the third control valve device 614*c* and a second cold water outlet connected to the cold water inlet of the fourth control valve device 614*d*.

A second hot water tee 648 in the hot water line 613 is downstream of the first hot water tee 636 and has a second hot water outlet connected to the hot water inlet of the third control valve device 614*c*, and a second hot water outlet is connected to the hot water inlet of the fourth control valve device 614*d*.

A third cold water tee 630*a* is connected to the cold water supply line and has a first cold water inlet connected to the cold water return outlet of the first control valve device and a second cold water inlet connected to the cold water return outlet of the second control valve device.

A third hot water tee 636*a* is connected to the hot water supply line and has a first hot water inlet connected to the hot water return outlet of the first control valve device and a second hot water inlet connected to the hot water return outlet of the second control valve device.

A fourth cold water tee 642*a* is connected to the cold water supply line downstream of the first cold water tee and has a first cold water inlet connected to the cold water return outlet of the third control valve device and a second cold water inlet connected to the cold water return outlet of the fourth control valve device.

A fourth hot water tee 648*a* is connected to the hot water supply line downstream of the first hot water tee and has a first hot water inlet connected to the hot water return outlet of the third control valve device and a second hot water inlet connected to the hot water return outlet of the fourth control valve device.

A first thermostat 654, second thermostat 656, third thermostat 658, and fourth thermostat 660 are each configured to sense the temperature of the space or fluid, generally S.

A first pump 662 is provided in fluid communication with the first fan coil 608*a* or chilled beam 610*a* and the cold water output and/or the hot water output of the first control valve 614*a*.

A second pump 664 is provided in fluid communication with the second fan coil 608*b* or chilled beam 610*b* and the cold water output and/or the hot water output of the second control valve 614*b*.

A third pump 666 is provided in fluid communication with the fan coil 608*c* or chilled beam 610*c* and the cold water output and/or the hot water output of the third control valve 614*c*

A fourth pump 668 is in fluid communication with the fourth fan coil 608*d* or chilled beam 610*d* and the cold water output and/or the hot water output of the fourth control valve 614*d*.

It is to be understood that the configuration of the pumps 662, 664, 666, and 668 in the figures are exemplary implementations. For example, instead of pump 662 being in fluid communication with a cold water outlet, it could instead be configured to be in fluid communication with a hot water outlet. The other pumps 664, 666, and 668 could similarly be reconfigured as desired, being in mind that placement of the pumps depends on whether it is desired to move hot or cold water through a particular portion or portions of the system 600. Additionally, although not shown, additional pumps could be provided for each of the cold water and/or hot water outputs, if desired.

The first thermostat 654 is in communication with at least one of the first control valve 608*a*, the first pump 662, and the first fan coil 608*a* or chilled beam 610*a* and is configured to selectively control the flow rates of the cold water and/or hot water through the first control valve 608*a*, the first pump 662, and the first fan coil or chilled beam.

The second thermostat 656 is in communication with at least one of the second control valve 608*b*, the second pump 664, and the second fan coil or chilled beam and is configured to selectively control at least one of the flow rates of cold water or hot water through the second control valve, the second control pump, and the second fan coil or chilled beam.

The third thermostat 658 is in communication with at least one of the third control valve 608*c*, the third pump 666, the third fan coil or chilled beam and is configured to selectively control at least one of the flow rates of cold water and/or hot water through the third control valve, the third control pump, and the third fan coil or chilled beam.

Additionally, the fourth thermostat 660 is in communication with at least one of the fourth control valve 608*d*, the fourth pump 668, and the fourth fan coil or chilled beam and is configured to selectively control at least one of the flow rates of cold water and/or hot water through the fourth control valve, the fourth control pump, and the fourth fan coil or chilled beam.

Heat recovery systems 100, 100*a*, 100*b*, and 606; valve devices 614*a*, 614*b*, 614*c*, and 614*d*; fan coils 608*a*, 608*b*, 608*c*, and 608*d*; active chilled beam devices 610*a*, 610*b*, 610*c*, and 610*d*; thermostats 654, 656, 658, and 660; pumps 662, 664, 666, and 668 are all be electrical powered by an electrical power source (not show) using one or more wires, cables, busses, and/or other typical electrical connection and transmission components (none shown).

In one exemplary implementation, thermostats 654, 656, 658, and 660 could include Loadmatch® Thermostats sold by Taco Comfort Solutions, 1160 Cranston St., Cranston, RI 02920, although other suitable thermostat could also be used.

In one exemplary implementation, pumps 662, 664, 666, and 668 could include Loadmatch® Circulators sold by Taco Comfort Solutions, 1160 Cranston St., Cranston, RI 02920, although other suitable thermostat could also be used.

In additional exemplary implementations a housing 680 is provided, one exemplary implementation of which is shown in FIGS. 10-13, which includes: the first control valve device 614*a*, the second control valve device 614*b*, the third control valve device 614*c*, and the fourth control valve device 614*d*; the cold water inlet 616, the cold water outlet 618, the cold water output, the cold water return 622, the hot water output, and the hot water return inlet; the first cold water tee 630, the second hot water tee, the second cold water tee 642, and/or the second hot water tee 648.

In one implementation, a method of the present disclosure includes use of a water distribution system including fittings (such as, but not limited to, Loadmatch® Twin-Tee® fittings sold by Taco Comfort Solutions, 1160 Cranston St., Cranston, RI 02920), generally 702 (FIGS. 10-13), for allowing cold water received by a control valve device 614 from cold water supply line 612 by a cold water inlet 616 to be removed from the cold water supply line, and for such cold water to flow through a fan coil 608 or chilled beam 610, and then such cold water returned, i.e., reintroduced, into the same cold water supply line 612. This cold water then continues downstream to the next downstream control valve device 614, where the cold water (now, somewhat less cold after previously passing through fan coil 608 or chilled beam 610, is again sent out through the next in line fan coil 608 or chilled beam 610.

Similarly, in an implementation of the present disclosure, a method includes hot water received by a control valve device 614 from hot water supply line 613 by a hot water inlet 624 to be removed from the hot water supply line, and for such hot water to flow through a fan coil 608 or chilled beam 610, and then such hot water returned to the same hot water supply line 613. The hot water then continues downstream to the next downstream control valve device 614, where the hot water (now, somewhat less hot after previously passing through fan coil 608 or chilled beam 610, is again sent out through the next in line fan coil 608 or chilled beam 610.

In order to maintain the cold water and/or hot water circulated through the system 600 within desired and/or or predetermined ranges, the operational speeds, parameters, refrigerant flow rates and/or water flow rates are modulated in accordance with software-based and/or manual controllers by controlling operation of the heat recovery systems (100, 100*a*, 100*b*, and/or 606), the control valve devices (614*a*, 614*b*, 614*c*, and/or 614*d*), the fan coils (608*a*, 608*b*, 608*c*, and/or 608*d*), the active chilled beam devices (610*a*, 610*b*, 610*c*, and 610*d*), and/or the pumps (662, 664, 666, and/or 668), based on temperature and/or humidity sensing of thermostats 654, 656, 658, and/or 660 and/or humidistats. Such a configuration allows for the adjustment of the water temperature of the system 600 through varying the water velocity in the system 600 or portions thereof.

The system 600 allows for use of only two pipes, the cold water supply line 612 and the hot water supply line 613, in order to be able to distribute hot or cold water out to the fan coils and/or chilled beams. However, if desired, the system 600 could be a four pipe system, with two cold water lines and two hot water lines, in which case the tees 630, 630*a*, 636, 636*a*, 642, 642*a*, and 648, 648*a* could be eliminated. In the four pipe version, one cold water supply line and one hot water supply line could supply control valve devices 614*a* and 614*c*, and one cold water supply line and one hot water supply line could supply control valve devices 614*b* and 614*d* with the fluid connections otherwise being in a similar manner as discussed above.

In one non-limiting exemplary implementation, hot water sent out to the to the fan coils and/or chilled beams is at 160° F., and after there is heat transfer through the to the fan coil and/or chilled beam, the hot water is returned back into the same hot water supply pipe 213, and the hot water that continues on, because of the mixing and velocity, may, when it gets to the next fan coil, be a 159° F.

In another one non-limiting exemplary implementation shown in FIG. 15, hot water sent out from a heat recovery system 606 at approximately 120° F. at 12 gallons per minute would be approximately 100° F. when it returns to heat recovery system 606, and cold water sent out from system 606 at approximately 44° F. at 12 gallons per minute would be approximately 52° F. when it returns to heat recovery system 606.

In another non-limiting exemplary implementation, the system 600 shown in housing 680 is a four zone box, configuration, meaning, it can be used to control the temperature in four spaces.

Also, the configuration of the system 600 lends itself to use of flexible PEX (or crosslinked polyethylene) rather than black iron or cooper piping. PEX is typically faster to install than metal or rigid plastic piping and may require less fittings and less skill to install (thereby potentially reducing labor costs).

Accordingly, implementations of the present disclosure result in heat source optimization systems capable of heating and chilling one or more non-toxic secondary fluids, including without limitation water, with the ability to increase efficiencies by: calculating and selecting in real-time whether to use air or groundwater/ground loop sources for heat intake and/or heat absorption sinks; and/or by selectively accumulating refrigerant and moving such refrigerant within such systems in a manner to reduce the likelihood of refrigerant starvation or over pressurization from occurring in such systems. Also, because such systems use a non-toxic secondary fluid the risk of injury to persons in the event of a refrigerant leak is significantly reduced. Additionally, the system 600 allows for two-pipe fan coil devices to be used instead of four pipe fan coil units, thereby allowing for use of lower-cost fan coil units that require less piping, labor, connectors, etc. to install, operate, and maintain.

In various exemplary implementations of the present disclosure, the system 600 and methods disclosed herein, in effect, move heat energy from one place to another, in that the heat picked up by the cold water loop's return flows can be used in the heat recovery chiller (HRC) 606 to heat the hot water supplied by the HRC to the system 600, which in turn, is used to heat a desired space and/or fluid. The cold water loop and hot water loops of exemplary implementations of the disclosure thus tend to potentially reduce overall energy consumption. For example, in cooling a computer room with a fan coil or chilled beam, the cold water loop picks heat in the computer room and returns with that heat to the HRC, and the HRC then takes that heat and it transfers it from the "cold side" of the HRC to the "hot side" of the HRC, so that such heat can be used in the hot water loop, to be available for use in heating a space and/or fluid.

Different examples of the apparatus(es), systems, and method(s) disclosed herein include a variety of components, features, and functionalities. It should be understood that the various examples of the apparatus(es), systems, and method(s) disclosed herein may include any of the components, features, and functionalities of any of the other examples of the apparatus(es) and method(s) disclosed herein in any combination, and all of such possibilities are intended to be within the spirit and scope of the present disclosure.

Many modifications and other implementations of the disclosure set forth herein will come to mind to one skilled in the art to which these disclosure pertain having the benefit of the teachings presented in the foregoing descriptions and the associated drawings. Therefore, it is to be understood that the disclosure are not to be limited to the specific implementations disclosed and that modifications and other implementations are intended to be included within the scope of the appended claims.

Moreover, although the foregoing descriptions and the associated drawings describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A system for controlling water distribution in systems, having a cold water supply in communication with a cold water supply line and a hot water supply in communication with a hot water supply line, used in at least one of a heating, ventilation, air conditioning, refrigeration, fluid heating and chilling configuration for heating or cooling a space or a fluid, the system comprising:

a plurality of fan coil devices;

a plurality of control valve devices, each of which being a six-way control valve and having:

a cold water inlet in fluid communication with, and configured to receive cold water from, the cold water supply line;

a cold water outlet in fluid communication with, and configured to supply cold water to, the cold water supply line;

a cold water output in fluid communication with, and configured to supply cold water from, the cold water supply to at least one of the plurality of fan coil devices;

a cold water return inlet in fluid communication with, and configured to receive from, at least one of the plurality of fan coil devices, the cold water being supplied by the cold water output, and the cold water being output to the cold water supply line via the cold water outlet;

a hot water inlet in fluid communication with the hot water supply line;

a hot water return outlet in fluid communication with the hot water supply line;

a hot water output in fluid communication with, and configured to supply hot water from, the hot water supply to at least one of the plurality of fan coil devices; and a hot water return inlet in fluid communication with, and configured to receive from, at least one of the plurality of fan coil devices, the hot water being supplied by the hot water output, and such hot water being output to the hot water supply line via the hot water return outlet;

a plurality of cold water tees, including:

at least one cold water tee connected to the cold water supply line having a first cold water outlet connected to the cold water inlet of a first control valve device, and a second cold water outlet connected to the cold water inlet of a second control valve device; and at least one cold water tee connected to the cold water supply line having a first cold water inlet connected to the cold water return outlet of a first control valve device, and a second cold water inlet connected to the cold water return outlet of a second control valve device;

a plurality of hot water tees, including:

at least one hot water tee connected to the hot water supply line having a first hot water outlet connected to the hot water inlet of a first control valve device, and a second hot water outlet connected to the hot water inlet of a second control valve device; and at least one hot water tee connected to the hot water supply line having a first hot water inlet connected to the hot water return outlet of a first control valve device, and a second hot water inlet connected to the hot water return outlet of a second control valve device;

at least one thermostat configured to sense a temperature of at least one of the space or the fluid; and at least one pump in fluid communication with a fan coil device of the plurality of fan coil devices and at least one of the cold water output and the hot water output of a control valve of the plurality of control valves, wherein:

the at least one pump is configured and positioned to selectively receive both hot water and cold water from the control valve, and the at least one thermostat is in communication with at least one of a control valve of the plurality of control valves, the at least one pump, and a fan coil device of the plurality of fan coil devices, and is configured to selectively control at least one of a flow rate of cold water or a flow rate of hot water through the control valve, pump, and fan coil device.

2. The system of claim 1, further comprising the cold water supply and the hot water supply, each including a heat recovery chiller.

3. The system of claim 1, further comprising a housing including:

the plurality of control valve devices;

the cold water inlet, the cold water outlet, the cold water output, the cold water return, the hot water output, and the hot water return inlet;

the plurality of cold water tees; and the plurality of hot water tees.

4. A system for controlling water distribution in systems, having a cold water supply in communication with a cold water supply line and a hot water supply in communication with a hot water supply line, used in at least one of a heating, ventilation, air conditioning, refrigeration, fluid heating and chilling configuration, the system comprising:

a plurality of chilled beam devices;

a plurality of control valve devices, each of which being a six-way control valve and having:

a cold water inlet in fluid communication with, and configured to receive cold water from, the cold water supply line;

a cold water outlet in fluid communication with, and configured to supply cold water to, the cold water supply line;

a cold water output in fluid communication with, and configured to supply cold water from, the cold water supply to at least one of the plurality of chilled beam devices;

a cold water return inlet in fluid communication with, and configured to receive from, at least one of the plurality of chilled beam devices, the cold water being supplied by the cold water output, and the cold water being output to the cold water supply line via the cold water outlet;

a hot water inlet in fluid communication with the hot water supply line;

a hot water return outlet in fluid communication with the hot water supply line;

a hot water output in fluid communication with, and configured to supply hot water from, the hot water supply to at least one of the plurality of chilled beam devices; and a hot water return inlet in fluid communication with, and configured to receive from, at least one of the plurality of chilled beam devices, the hot water being supplied by the hot water output, and such hot water being output to the hot water supply line via the hot water return outlet;

a plurality of cold water tees, including:

at least one cold water tee connected to the cold water supply line having a first cold water outlet connected to the cold water inlet of a first control valve device, and a second cold water outlet connected to the cold water inlet of a second control valve device; and at least one cold water tee connected to the cold water supply line having a first cold water inlet connected to the cold water return outlet of a first control valve device, and a second cold water inlet connected to the cold water return outlet of a second control valve device;

a plurality of hot water tees, including:

at least one hot water tee connected to the hot water supply line having a first hot water outlet connected to the hot water inlet of a first control valve device, and a second hot water outlet connected to the hot water inlet of a second control valve device; and at least one hot water tee connected to the hot water supply line having a first hot water inlet connected to the hot water return outlet of a first control valve device, and a second hot water inlet connected to the hot water return outlet of a second control valve device;

at least one thermostat configured to sense a temperature of at least one of the space or the fluid; and at least one pump in fluid communication with a fan coil device of the plurality of fan coil devices and at least one of the cold water output and the hot water output of a control valve of the plurality of control valves;

wherein:

the at least one pump is configured and positioned to selectively receive both hot water and cold water from the control valve, and the at least one thermostat is in communication with at least one of a control valve of the plurality of control valves, a pump of the plurality of pumps, and a fan coil device of the plurality of fan coil devices, and is configured to selectively control at least one of a flow rate of cold water or a flow rate of hot water hot water through the control valve, pump, and fan coil device.

5. The system of claim 4, wherein at least one of the chilled beam devices is an active chilled beam device.

6. A system for controlling water distribution in systems, having a cold water supply in communication with at least one cold water supply line and a hot water supply in communication with at least one hot water supply line, used in at least one of a heating, ventilation, air conditioning, refrigeration, fluid heating and chilling configuration, the system comprising:

a plurality of fan coil devices;

a plurality of control valve devices, each of which being a six-way control valve and having:

a cold water inlet in fluid communication with, and configured to receive cold water from, at least one of the at least one cold water supply line, each cold water supply line being in fluid communication with the cold water supply;

a cold water outlet in fluid communication with, and configured to supply cold water to, at least one of the at least one cold water supply lines;

a cold water output in fluid communication with, and configured to supply cold water from the cold water supply to, at least one of the plurality of fan coil devices;

a cold water return inlet in fluid communication with, and configured to receive from, at least one of the plurality of fan coil devices, the cold water being supplied by the cold water output, and the cold water being output to at least one of the at least one cold water supply lines via the cold water outlet;

a hot water inlet in fluid communication with at least one of the at least one hot water supply line, each hot water supply line being in fluid communication with the hot water supply; and a hot water return outlet in fluid communication with at least one of the at least one hot water supply lines;

a hot water output in fluid communication with, and configured to supply hot water from, the hot water supply to at least one of the plurality of fan coil devices;

a hot water return inlet in fluid communication with, and configured to receive from, at least one of the plurality of fan coil devices, the hot water being supplied by the hot water output, and such hot water being output to at least one of the at least one hot water supply lines via the hot water return outlet;

at least one thermostat configured to sense a temperature of at least one of the space or the fluid;

at least one pump in fluid communication with a fan coil device of the plurality of fan coil devices and at least one of the cold water output and the hot water output of a control valve of the plurality of control valves, wherein:

the at least one pump is configured and positioned to selectively receive both hot water and cold water from the control valve, and the at least one pump is in communication with at least one of a control valve of the plurality of control valves, a pump of the plurality of pumps, and a fan coil device of the plurality of fan coil devices, and is being configured to selectively control at least one of a flow rate of cold water or a flow rate of hot water through the control valve, pump, and fan coil device.

7. A system for controlling water distribution in systems, having a cold water supply in communication with at least one cold water supply line and a hot water supply in communication with at least one hot water supply line, used in at least one of a heating, ventilation, air conditioning, refrigeration, fluid heating and chilling configuration, the system comprising:

a plurality of chilled beam devices;

a plurality of control valve devices, each of which being a six-way control valve and having:

a cold water inlet in fluid communication with, and configured to receive cold water from, at least one of the at least one cold water supply line, each cold water supply line being in fluid communication with the cold water supply;

a cold water outlet in fluid communication with, and configured to supply cold water to, at least one of the at least one cold water supply lines;

a cold water output in fluid communication with, and configured to supply cold water from, the cold water supply to at least one of the plurality of chilled beam devices;

a cold water return inlet in fluid communication with, and configured to receive from, at least one of the plurality of chilled beam devices, the cold water being supplied by the cold water output, and the cold water being output to at least one of the at least one cold water supply lines via the cold water outlet;

a hot water inlet in fluid communication with at least one of the at least one hot water supply line, each hot water supply line being in fluid communication with the hot water supply;

a hot water return outlet in fluid communication with at least one of the at least one hot water supply lines;

a hot water output in fluid communication with, and configured to supply hot water from, the hot water supply to at least one of the plurality of chilled beam devices;

a hot water return inlet in fluid communication with, and configured to receive from, at least one of the plurality of chilled beam devices, the hot water being supplied by the hot water output, and such hot water being output to at least one of the at least one hot water supply lines via the hot water return outlet;

at least one thermostat configured to sense a temperature of at least one of the space or the fluid; and at least one pump in fluid communication with a chilled beam device of the plurality of chilled beam devices and at least one of the cold water output and the hot water output of a control valve of the plurality of control valves, wherein:

the at least one pump is configured to selectively receive both hot water and cold water from the control valve, and the at least one thermostat is in communication with at least one of a control valve of the plurality of control valves, a pump of the plurality of pumps, and a chilled beam device of the plurality of chilled beam devices, and is configured to selectively control at least one of a flow rate of cold water or a flow rate of hot water through the control valve, pump, and chilled beam device.

8. The system of claim 7, wherein the cold water supply and the hot water supply is a heat recovery chiller.

* * * * *